US005399243A

United States Patent [19]

Miyamoto et al.

[11] Patent Number: 5,399,243

[45] Date of Patent: Mar. 21, 1995

[54] PULP MOLDING DIE FOR MOLDING SHAPED PULP ARTICLES, METHOD, APPARATUS, AND SHAPED PULP ARTICLE

[75] Inventors: Yasuhiro Miyamoto, Handa; Toshiaki Ishihara, Nagoya; Minoru Uda, Handa, all of Japan

[73] Assignee: NGK Insulators, Ltd., Japan

[21] Appl. No.: 25,342

[22] Filed: Mar. 3, 1993

[30] Foreign Application Priority Data

| | | | |
|---|---|---|---|
| Mar. 6, 1992 | [JP] | Japan | 4-049355 |
| Jun. 11, 1992 | [JP] | Japan | 4-151956 |
| Sep. 3, 1992 | [JP] | Japan | 4-235928 |
| Feb. 24, 1993 | [JP] | Japan | 5-035840 |

[51] Int. Cl.[6] ..... D21J 7/00

[52] U.S. Cl. ..... 162/274; 162/199; 162/382

[58] Field of Search ..... 162/410, 199, 272, 382, 162/274, 275, 389; 425/84, 85; 264/86, 87; 249/113, 141

[56] References Cited

U.S. PATENT DOCUMENTS

| | | | |
|---|---|---|---|
| 2,187,918 | 1/1940 | Sloan | 249/141 |
| 2,859,669 | 11/1958 | Leitzel . | |
| 3,132,991 | 5/1964 | Hornbostel et al. . | |
| 3,228,826 | 1/1966 | Eastman et al. | 162/199 |
| 3,325,349 | 6/1967 | Reifers . | |
| 3,619,353 | 11/1981 | Williams . | |
| 4,500,435 | 2/1985 | Muller . | |

FOREIGN PATENT DOCUMENTS

| | | |
|---|---|---|
| 3837467 | 5/1990 | Germany . |
| 60-9704 | 1/1985 | Japan . |
| 898416 | 6/1962 | United Kingdom . |
| 945781 | 1/1964 | United Kingdom . |
| 1104333 | 2/1968 | United Kingdom . |
| 1589077 | 5/1981 | United Kingdom . |
| 2251402 | 7/1992 | United Kingdom . |
| 9000944 | 2/1990 | WIPO . |
| 90/04679 | 5/1990 | WIPO . |

*Primary Examiner*—W. Gary Jones
*Assistant Examiner*—Brenda Adele Lamb
*Attorney, Agent, or Firm*—Parkhurst, Wendel & Rossi

[57] ABSTRACT

A pulp molding die for molding shaped articles from fiber pulp is disclosed. The die has a porous molding layer having a porosity of at least 5% and an average pore diameter in a range of 60 to 1000 μm, the porous molding layer having a molding surface shaped to the configuration of the article to be molded; and a porous support layer disposed adjacent the porous molding layer on the opposite side thereof from the molding surface, the porous support layer having a porosity of at least 20% and an average pore diameter in a range of 0.6 to 10 mm, the average pore diameter being larger than that of the porous molding layer. The porous molding layer and/or the porous support layer have a pore structure for holding water. A method of molding shaped pulp articles from fiber pulp, has the steps of: (1) providing a pulp molding die as above; (2) molding a pulp article on the molding surface of the die by suction through the die; (3) removing the molded pulp article from the die; and (4) after repeating steps (2) and (3) at least once, applying cleaning water to the die to incorporate water in the pore structure of the die and thereafter applying air pressure to the die from inside the die to drive the incorporated water from the die, thereby removing fibers trapped in the die. An apparatus for molding shaped pulp articles from fiber pulp is disclosed.

14 Claims, 18 Drawing Sheets

PULP MOLDING DIE FOR MOLDING SHAPED PULP ARTICLES, METHOD, APPARATUS, AND SHAPED PULP ARTICLE

BACKGROUND OF THE INVENTION

This invention relates to a pulp molding die for molding pulp articles from used pulp and the like. Such pulp articles are suitably used as packaging and shock-absorbing materials, for example, egg boxes, fruit crates, packages for industrial products. This invention also relates to the method for molding such pulp articles.

Conventionally, in Japan, plastic and Styrofoam containers have mainly been used for packing industrial products, or the like. However, such containers add to environmental problems since they are not biodegradable, they release hazardous gas upon incineration, and so on. Therefore, conversion to fiber containers using old pulp, which can be reused many times, has come to be investigated.

The conventional pulp molding die consists of a main body and a wire mesh for the molding surface covering the main body. The wire mesh has a desired shape, which can be highly complex, of an article to be molded. The surface of the main body covered with the wire mesh also has complementary shape to the wire mesh. The main body is composed of aluminum blocks having numerous pores for water passage, and the blocks are joined together. The main body is joined to the wire mesh by connecting means such as bolts. The die may have a highly complex shape.

Washing the conventional molding die of the wire-mesh type using a shower of water at each interval of molding can prevent, to some extent, the water passage from becoming clogged. However, washing complexly shaped dies is extremely time consuming. Moreover, there are problems such as (1) the need for time, skill, and experience in the production of molding dies having complex shapes, (2) the difficulty in eliminating unwanted marks of the joints and patterns of the wire mesh from the surface of the final product, and (3) the inability to form letters or minute designs since the wire conventionally used cannot produce precise edges and corners. Further, when the pores for water passage are clogged, the operation has to be stopped and the molding die is washed by pressurized water.

Another type of a pulp molding die has been disclosed in Japanese Patent Laid-Open 60-9704. The die is composed of a single layer of particles forming the molding surface of a size chosen to provide a smooth surface. The particles, for example, made of ceramics, are bonded by a resin bonding agent, leaving pores. The thickness of this layer is 5–60 mm. There may be a backing plate (4 in FIG. 5); the specific example of this plate has a porosity of 7%.

However, this type of a die has some problems. In actual use, this mold (with the plate 4) may clog, because large areas of the porous molding layer are directly backed by unapertured areas of the plate. Thus the continuous production of the pulp articles is interrupted for a declogging procedure. Moreover, the die is prone to distortion during mass production, which requires the die to withstand repeated decompression, since the molding die is bonded only by the resin.

The present invention intends to solve the above-discussed conventional problems by providing a pulp molding die for molding pulp articles, which: (1) hardly experiences clogged pores, (2) can mold pulp articles having smooth surfaces, (3) is not prone to be damaged by repeated use, and (4) can be easily produced in a short amount of time. Moreover, the critical number of cycles in which molding a pulp article is continuously repeated without interruption can be greatly increased with the mold of the invention. The present invention is further intended to provide a pulp molding process, using the above-discussed pulp molding die, to greatly increase the critical number of possible continuous pulp moldings.

SUMMARY OF THE INVENTION

According to a first aspect of the invention, there is provided a pulp molding die for molding shaped articles from fiber pulp, comprising; a porous molding layer having a porosity of at least 5% and an average pore diameter in a range of 60 to 1000 $\mu$m, the porous molding layer having a molding surface shaped to the configuration of the article to be molded; a porous support layer disposed adjacent the porous molding layer on the opposite side thereof from the molding surface, the porous support layer having a porosity of at least 20% and an average pore diameter in a range of 0.6 to 10 mm, the average pore diameter being larger than that of the porous molding layer; and means for holding water in the die by capillary attraction, the means comprising a pore structure defined by at east one of the porous molding layer and the porous support layer.

Preferably at least one of the porous molding layer and the porous support layer has an interconnected pore structure.

Preferably the die has an air flow characteristic such that when air pressure of 300 mm Aq is applied at the molding surface the air flow rate, Q, through the die is $50 \leqq Q \leqq 600$, wherein Q is $ml.A^{-1}.s^{-1}$, A is the surface area of the molding surface in $cm^2$, ml is the volume of air in $cm^3$ that passes through the die, and s is seconds.

The porous support layer may comprise means for allowing substantially uniform flow of air through the porous molding layer over the entire area of the opposite side thereof.

Preferably the porous molding layer has a thickness in the range of 0.1 to 20 mm. The porous molding layer may have a thickness in a range of 0.1 to 5 mm.

Preferably at least 80% of the pores of the porous molding layer have pore diameters in the range 25% less than the average pore diameter thereof to 25% more than the average pore diameter thereof. Preferably the average pore diameter of the porous support layer is 1.5 to 10 times that of the porous molding layer.

Preferably at least one of the porous molding layer and the porous support layer is composed of a plurality of water-insoluble particles bonded together.

At least one of the porous molding layer and the porous support layer may be composed of a porous material formed by electroforming.

At least one of the porous molding layer and the porous support layer may be composed of a honeycomb structure.

At least one of the porous molding layer and the porous support layer may be composed of a perforated metal plate.

According to a second aspect of the invention, there is provided a method of molding shaped pulp articles from fiber pulp, comprising the steps of: (1) providing a pulp molding die comprising a porous molding layer having a porosity of at least 5% and an average pore diameter in a range of 60 to 1000 μm, the porous molding layer having a molding surface shaped to the configuration of the article to be molded; a porous support layer disposed adjacent the porous molding layer on the opposite side thereof from the molding surface, the porous support layer having a porosity of at least 20% and an average pore diameter in a range of 0.6 to 10 mm, the average pore diameter being larger than that of the porous molding layer; and means for holding water in the die by capillary attraction, the means comprising a pore structure defined by at least one of the porous molding layer and the porous support layer; (2) molding a pulp article on the molding surface of the die by suction through the die; (3) removing the molded pulp article from the die; and (4) after repeating steps (2) and (3) at least once, applying cleaning water to the die to incorporate water in the pore structure of the die and thereafter applying air pressure to the die from inside the die to drive the incorporated water from the die, thereby removing fibers trapped in the die.

Preferably the step (4) is performed in sequence each time after step (3).

Preferably the air pressure is applied so as to give a maximum pressure of at least 1.0 gf/cm$^2$ at the molding surface of the die. The air pressure may be applied as an impulse which rises to at least 1.0 gf/cm$^2$ at the molding surface of the die in less than 0.5 s.

Preferably an above-mentioned method further comprises connecting the die to a volume of pre-compressed air to provide the air pressure.

According to a third aspect of the invention, there is provided a shaped pulp article made by an above-mentioned method of molding shaped pulp articles from fiber pulp.

According to a fourth aspect of the invention, there is provided an apparatus for molding shaped pulp articles from fiber pulp, comprising: a pulp molding die comprising a porous molding layer having a porosity of at least 5% and an average pore diameter in a range of 60 to 1000 μm, the porous molding layer having a molding surface shaped to the configuration of the article to be molded; a porous support layer disposed adjacent the porous molding layer on the opposite side thereof from the molding surface, the porous support layer having a porosity of at least 20% and an average pore diameter in a range of 0.6 to 10 mm, the average pore diameter being larger than that of the porous molding layer; and means for holding water in the die by capillary attraction, the means comprising a pore structure defined by at least one of the porous molding layer and the porous support layer, the die having an inside surface remote from the molding surface; means for adding cleaning water to the die so that cleaning water is incorporated in the pore structure thereof; and means for applying air pressure to the inside surface of the die to drive water from the pore structure thereof.

The means for adding cleaning water may comprises spraying means for spraying cleaning water onto the molding surface of the die. Preferably the means for applying air pressure comprises a container for compressed air, a conduit connecting the container to the inside surface of the die, and a valve in the conduit.

A porosity in this specification refers to the volume ratio of the empty spaces in the porous molding layer and the porous support layer. For example, when either layer consists of particles, the total volume of the empty spaces between the particles determines the porosity.

The pulp molding die according to the present invention has a porous molding layer having a specific porosity and a specific average pore diameter, and such a regulated molding layer gives numerous advantages. First of all fibers do not easily enter tile porous molding layer. Secondly even if fibers enter the porous molding layer, the fibers are not easily trapped in the porous molding layer. Thirdly even if fibers are trapped in the porous molding layer, the fibers are easily removed by backwashing so that pulp molding operations can continue without clogging the die. Moreover pulp articles made with the pulp molding die of the invention have a smooth, beautiful surface. Finally the mold has a sufficiently porous structure such that short fibers can pass through the mold, and thus the mold does not get clogged easily.

The pulp molding die according to the present invention has a porous support layer adjacent to the porous molding layer on the opposite side thereof from the molding surface so that the die has a mechanical strength sufficient to withstand a pressure in a step of deposit a raw pulp material onto the die and another step of backwashing.

The pulp molding die may have a rigid body, being integral to the porous support layer to hold the porous support layer. The rigid body may be made of a metal or a synthetic resin. The rigid body will prevent the die of the invention from bending or breaking.

In a method for molding a pulp article, a die is introduced into a slurry containing fibers dispersed in a liquid. For example, the die is immersed in the slurry.

Then fibers in the slurry are deposit onto the molding surface of the die by draining the fluid from the slurry through the molding die. For example, the die is immersed in a slurry, and the fluid from the slurry is drained through the die by reducing the pressure on the inside of the die, followed by removing the die from the slurry. In this example, water absorbed in the deposit on the die is preferably dried to a certain degree by reducing the pressure on the inside of the die, and then the pulp article is removed from the die.

Fibers may be trapped in the porous molding layer in the die after molding a pulp article once or, more often than not, successively many times. To remove such trapped fibers, the die undergoes backwashing after every appropriate number of pulp molding operations. For example, the die may be backwashed every time after a pulp article is repeatedly molded twenty times. The backwashing of the die by water and air is accomplished by: applying cleaning water to the die after removal of a pulp article therefrom to incorporate water in the porous molding layer and/or the support layer of the die; and thereafter applying air pressure to the die from inside the die to drive the incorporated water from the die through the molding surface, thereby to remove fibers trapped in the die. A method of molding pulp articles according to the present invention includes this backwashing process so that the molding operations are smoothly repeated without clogging the die.

An apparatus for molding shaped pulp articles from fiber pulp of the present invention can prevent the die from getting clogged and allow continuous operation of molding pulp articles without interruption.

BRIEF DESCRIPTION OF THE DRAWINGS

Further details are explained below with the help of the examples illustrated in the attached drawings in which:

FIG. 9(*b*) is a lateral cross section of an embodiment of the pulp molding die according to the present invention in which the porous molding layer is composed of particles bonded together, and the porous support layer is composed of a honeycomb structure;

FIG. 9(*c*) is a lateral cross section of an embodiment of the pulp molding die according to the present invention in which the porous molding layer is formed by electroforming, and the porous support layer is composed of a honeycomb structure;

DETAILED DESCRIPTION OF THE INVENTION

Figure 1:
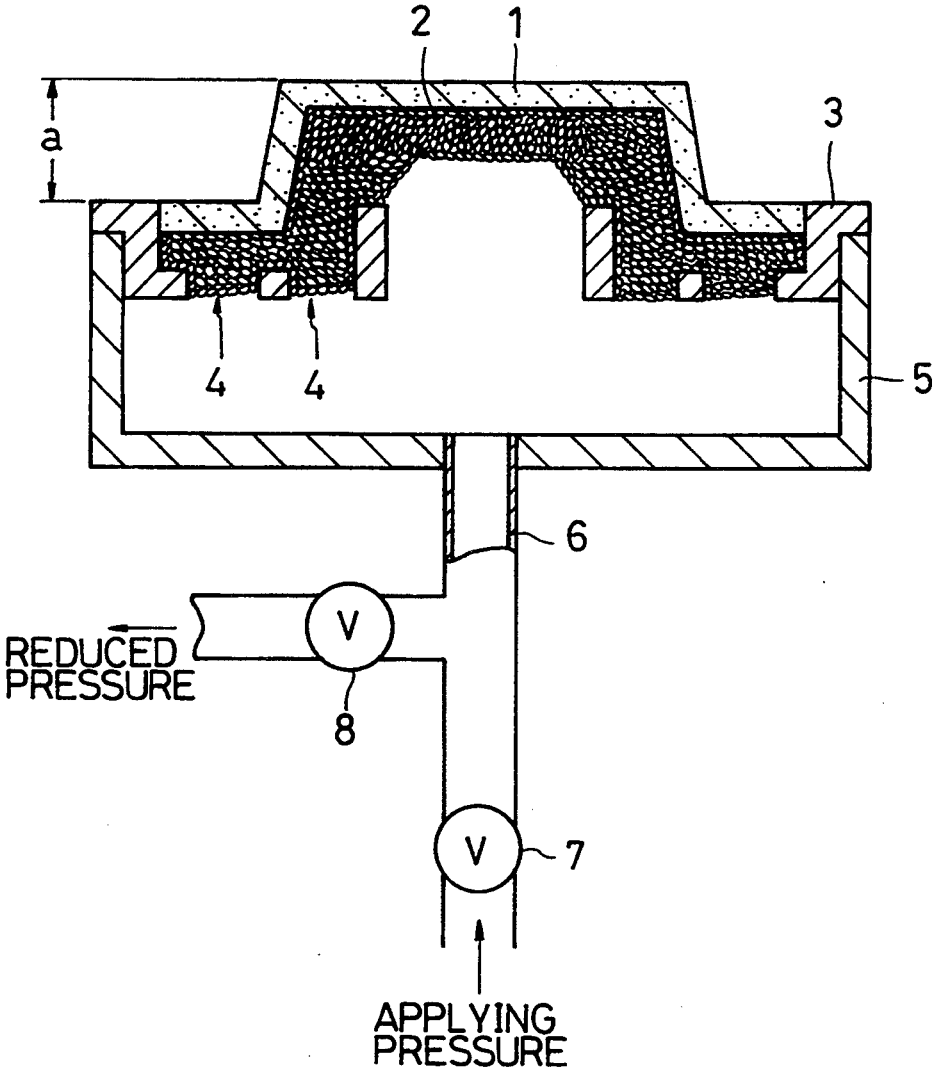
FIG. 1 is a lateral cross section though an embodiment of the pulp molding die according to the present invention.

In FIG. 1 the die has a porous molding layer 1, a support layer 2, and a rigid body 3. The porous molding layer 1 has a molding surface shaped to the desired configuration of the article to be molded. The porous molding layer 1 has an inside surface on the opposite side of the molding surface. A porous support layer 2 is adjacent to the inside surface of the porous molding layer 1. A rigid body 3 is integral to the porous support layer 2, and the rigid body 3 has drains 4. The rigid body 3 and a housing 5 define a chamber. The chamber is connected to a pressure chamber (not shown) and to a vacuum chamber (not shown ) through conduit 6 by means of solenoid-operated valves 7 and 8, respectively.

The porous molding layer 1 has a porosity of at least 5%. When the molding layer 1 has a porosity less than 5%, the resulting die may not have sufficient drainage so that a molding operation becomes inefficient. Preferably the porous molding layer 1 has a porosity of at least 10%.

Molding layer 1 has an average pore diameter in the range of 60 to 1000 μm. When the porous molding layer has an average pore diameter less than 60 μm, fibers are prone to get trapped in such a molding layer and the trapped fibers are not easily removed by the backwash process. In contrast, when the porous molding layer has an average pore diameter greater than 1000 μm, fibers are prone to get trapped in such a molding layer in a molding operation. Besides, a pulp article made with such a pulp molding die, has a rough surface. Preferably the molding layer 1 has an average pore diameter in the range of 120 to 700 μm.

Preferably at least 80% or, more preferably, at least 85% of the pores of the porous molding layer have pore diameters in the range of 25% less than the average pore diameter thereof to 25% more than the average pore diameter thereof. When pore diameters have large variance, a permeability of one part of a molding layer 1 may differ from that of the other part, and the molding die is more prone to clogging.

Preferably the porous molding layer 1 has a thickness in the range of 0.1 to 20 mm. Though a thin molding layer is favorable, a very thin molding layer having a thickness less than 0.1 mm may not have sufficient strength or stability in the long run. When the porous molding layer 1 has a thickness larger than 20 mm, the porous molding layer is more prone to have fibers trapped therein. Moreover, the porous molding layer may not be cleaned as efficiently by the backwash process.

More preferably the porous molding layer 1 has a thickness in the range of 0.1 to 10 mm. It is further preferable that a thickness of the porous molding layer 1 is at least 0.1 mm and less than 5 mm.

A porous support layer 2 supports the porous molding layer 1, and the porous support layer 2 is adjacent to and may be bonded to the inside surface 1*b* of the porous molding layer 1.

The porous support layer 2 has a porosity of at least 20%, preferably at least 25%, and an average pore diameter of the porous support layer 2 is larger than the average pore diameter of the porous molding layer 1. When a support layer has a porosity smaller than 20%, or when the average pore diameter of the porous support layer is smaller than the average pore diameter of the porous molding layer, the resulting die may not have sufficient drainage so that a molding operation becomes inefficient. Moreover, the porous molding layer may not be cleaned as efficiently by the backwash process so that the die is more prone to clogging. Preferably the average pore diameter of the porous support layer 2 is in the range 0.6 to 10 mm, and further preferably in the range of 0.7 to 6 mm.

The porous support layer 2 may be adapted to allow substantially uniform flow of air through the porous molding layer over the whole area thereof. When this condition is not met, in the backwash process the pressurized air may flow to areas with larger air flow and may not flow to areas with smaller air flow, and consequently, fibers trapped in the latter areas remain trapped.

The porous support layer 2 has an average pore diameter ranging from 0.6 to 10 mm, preferably from 0.7 to 6 mm. When the porous support layer has an average pore diameter larger than 10 mm, the porous support layer may not have sufficient mechanical strength to support the porous molding layer 1.

Preferably the average pore diameter of the porous support layer 2 is 1.5–10 times than that of the porous molding layer 1. When the average pore diameter of the porous support layer 2 is outside of this range, the resulting die may not have sufficient drainage so that a molding operation becomes inefficient. Moreover, the porous molding layer may not be efficiently cleaned by the backwash process, and the die is more prone to clogging. The porous support layer 2 may have an average pore diameter larger by two to six times an average pore diameter of the porous molding layer 1.

The die of the present invention has, located in at least one of the porous molding layer and the porous support layer, an interconnected pore structure able to hold water. Preferably water is held by capillary action. The interconnected pore structure is quite efficient in drainage, allowing fibers in a slurry to deposit quickly on the die.

Neither the porous molding layer 1 nor the porous support layer 2 has to have an upper limit in their porosity. However, either layer with too much porosity may not have sufficient mechanical strength. From this point of view, the porosity of the porous molding layer 1 and the porous support layer 2 should not exceed 95%.

The porous molding layer 1 and the porous support layer 2 have certain ranges of porosity and average pore diameters as mentioned above. Moreover, the molding unit consisting of the porous molding layer 1 and the supporting layer 2 may have certain ranges of porosity and average pore diameters so that the molding unit has a certain air flow characteristic as a parameter for its permeability to air and liquid.

Preferably the mold has an air flow characteristic such that when air pressure of 300 mm Aq is applied at the molding surface the air flow rate, Q, through the die is $50 \leqq Q \leqq 600$, wherein Q is $ml.A^{-1}.s^{-1}$. A is the surface area of the molding surface in $cm^2$, ml is the volume of air in $cm^3$ that passes through said die, and s is seconds.

When the air flow rate Q is less than 50 ($ml.A^{-1}.s^{-1}$), the molding unit may not have sufficient drainage so that a molding operation becomes inefficient. Moreover, the molding unit is more prone to clogging. On the other hand, when the air flow rate Q is larger than 600 ($ml.A^{-1}.s^{-1}$), a backwash process does not work effectively, failing to prevent clogging of the molding unit.

The porous molding layer 1 and the supporting layer 2 of the die may be composed of any material formed by any method as long as they have pores satisfying these characteristics mentioned above. Examples are shown as follows:

(1) the porous molding layer 1 and/or the porous support layer 2 has a plurality of particles bonded together leaving empty spaces between the particles and the particles are insoluble to water;

(2) the porous molding layer 1 and/or the porous support layer 2 has a porous material formed by electroforming;

(3) the porous molding layer 1 and/or the porous support layer 2 has a honeycomb structure; and (4) the porous molding layer 1 and/or the porous support layer 2 has a perforated metal plate.

FIGS. 1–5 show embodiments of the invention in which both the porous molding layer 1 and the porous support layer 2 have a plurality of particles bonded together. The particles are composed of any water-insoluble material, such as glass, ceramic, synthetic resin, metal and so on. Glass beads are preferable as the particles. It is easy to choose glass beads having desirable sizes, and thus it is easy to control porosity and pore diameters of the layer made of glass beads.

The particles are preferably bonded by a resin bonding agent such as epoxy resin to form the porous molding layer 1 and the porous support layer 2. The bonding agent is not limited to epoxy resins, but it also includes resins that harden upon heat such as urethane resins, melamin resins, phenol resins, alkyd resins, etc. The bonding agent may be brazing filler metal such as brazing filler copper, brazing filler silver, and brazing filler nickel, etc. The bonding agent may be soldering materials to be soldered, frits, and thermoplastic resins. Alternatively the particles may be bonded together without any bonding agent; the particles may be bonded by, for example, sintering the particles.

The mixture ratio of the resin bonding agent to particles is preferably 3–15% by volume. When the ratio is lower than 3%, the bonding strength is not sufficient, resulting in increased possibility of damage. When the ratio is higher than 15%, enough space may not be available between the particles, and the permeability becomes lower, causing deterioration of the productivity.

The die in which both the porous molding layer 1 and the porous support layer 2 are composed of water-insoluble particles are hereinafter described.

The particles composing the porous molding layer may have an average diameter in the range of 0.2 to 1.0 mm. The molding layer may have a thickness larger by one to 20 times the average diameter of the particles.

The average diameter of the particles for the porous molding layer 1 may range from 0.2–1.0 mm, preferably 0.4–0.9 mm, and, more preferably 0.6–0.8 mm. When the particles are smaller than 0.2 mm in diameter, the empty spaces between each particle is so small that the necessary permeability cannot be obtained and the productivity in molding deteriorates. When the particles are larger than 1.0 mm in diameter, the empty spaces between each particle are so wide that fibers enter the molding die, resulting in protuberant roughness on the surface of the obtained pulp articles, facilitated clogging of the die, and increased difficulty in the separation of the pulp articles from the molding die.

The particles forming the porous molding layer 1 have relatively uniform particle diameters. Preferably at least 80% of the particles have diameters in the range of ±0.2 mm from the average diameter of the particles. When the particle diameters do not meet this standard, empty spaces between particles may have varying sizes, resulting in an inhomogeneous surface of the molded fiber body. It is more preferable that at least 80% of the particles have diameters in the range of ±0.15 mm from the average diameter of the particles.

Preferably the porous molding layer 1 has a thickness larger by 1 to 20 times than the average diameter of the molding particles. The thickness of the layer needs to be at least the same as the average diameter of the particles forming the porous molding layer 1 to prevent the molded pulp articles from having a rough surface. When the thickness of the layer is larger than 20 times the average diameter of the molding particles, the porous molding layer is prone to clogging, and the backwashing does not work effectively. Specifically a thickness of the porous molding layer 1 may range from 0.2 to 20 mm, preferably from 0.2 to 10 mm. It is further preferable that a thickness of the porous molding layer 1 is at least 0.1 mm and less than 5 mm.

The porous support layer 2, disposed on the inside surface of the porous molding layer 1, has sufficient mechanical strength and sufficient permeability toward air and water. For this purpose the porous support layer may be composed of bonded particles having an average diameter of 1.0–10.0 mm, being larger than the average diameter of the particles in the porous molding layer 1, and having a thickness at least the same as the average diameter of the particles of the porous support layer 2.

It is necessary for the particles of the porous support layer 2 to have a diameter of at least 1 mm so as to obtain the effect of washing the molding die. When the method of the present invention is applied, high effect of washing by a counter flow, i.e. backwashing, can be obtained by using the particles in the layer 2 preferably having an average diameter 1.5 to 10 times, more preferably 2–5 times, larger than the average diameter of the particles in the layer 1. When the average diameter of the particles in the layer 2 is smaller than 1.5 times or 2 times that of the particles in layer 1, enough backwash pressure may not be obtained due to a pressure loss.

On the other hand when the average diameter of the particles in the layer 2 is larger than 10 times that of the particles in layer 1, particles in the porous molding layer 1 may be stuck between the particles of the porous support layer 2, causing the die to clog.

Specifically the average diameter of the particles of the porous support layer 2 may be 1.0–10.0 mm, preferably 2.0–5.0 mm.

Preferably the surface of the porous support layer 2 facing the porous molding layer 1, may have particles having diameters up to 5 mm. This limitation helps avoid potential inclusion of smaller particles of the porous molding layer 1 into empty spaces between larger particles of the porous support layer at their interface, which may lead to clogging, though the particles at the surface having diameters larger than 5 mm strengthen the bonding strength between the molding layer 1 and the porous support layer 2.

The porous support layer 2 may have a thickness of at least the average diameter of the support particles in support layer 2, preferably 2–10 times as thick as the average diameter thereof. When the porous support layer 2 is thinner than the average diameter of the particles thereof 2, the surface strength of the molding die cannot be ensured. Moreover, when the porous support layer 2 does not have a thickness of at least 2 times the average diameter of particles in that layer, some parts of the die may have a higher pressure than the other parts during a backwashing process so that the parts with less pressures are prone to leave some trapped fibers. This would also apply to a molding die having a rigid body having apertures. Therefore the thickness of the porous support layer should be at least twice the average diameter of the particles in the porous support layer On the other hand when the porous support layer 2 is thicker than 10 times the average diameter of the particles in the porous support layer 2, the pressure applied to the molding surface upon washing by a counter flow is not enough, thus causing clogging.

Considering a pressure loss due to the porous support layer 2, it is preferable to make the porous support layer 2 thin, more preferably, 3–7 times the average diameter of particles thereof. However, even if the porous support layer 2 should, for example, have a thickness about 10 times the average diameter of particles thereof, the molding die can be washed just as effectively as when the thickness if 3–7 times, if the pressure from the inside is increased and apertures are added.

Preferably the porous support layer 2 is integrally formed with a rigid body 3. The rigid body 3 can be made from any kind of material, such as metal or plastic, which can maintain a given strength to back up the porous support layer 2. It is also possible to have a back-up layer, as a rigid body 3, formed by bonding particles such as glass beads having a larger average particle diameter than the average diameter of particles in the porous support layer 2.

When a metal plate, for example made of aluminium alloy, having a plurality of apertures, is used as the rigid body 3, the thickness is preferably at least 5 mm, more preferably 10–20 mm. When the thickness is less than 5 mm, the rigidity of the body deteriorates and the layer 2 is prone to be damaged by distortion caused by repeated load upon molding pulp articles. Aluminium, which Young's modulus is about 7000 kgf/mm$^2$, has far higher rigidity compared with a resin bonding material, which Young's modulus is 1000 kgf/mm$^2$. By replenishing particles used in the porous support layer 2 in the apertures 4 of the rigid body, the bonding strength can be enhanced. It is possible that the frame has a structure having ribs to obtain both light weight and strength.

Some embodiments of the invention may not require a rigid body 3 to be rigid. For example, the molding surface may have a small area and a pressure applied during molding pulp articles by suction is limited. In some cases a number of the pulp articles to be molded is limited. In these instances the strength of the molding die can be ensured by increasing the thickness of the layer 2, and the box-shaped frame as a rigid body can be used only in the peripheral part of the molding die and at the joint with chamber 5, on which pressure is easily applied.

When the die has a box-shaped rigid body 3, the shape of the molding surface can be changed by replacement of a molding unit consisting of the porous molding layer 1 and the porous support layer 2, keeping the same rigid body 3. It makes the production of the pulp molding die easy, and the modification of the shape of the molding die easy. Therefore, the molding die can be produced at low cost. Further, in this type of pulp molding die, clogging can be eliminated easily by stopping the operation and washing the molding die by pressurized water in the same way as the conventional method.

Figure 2:
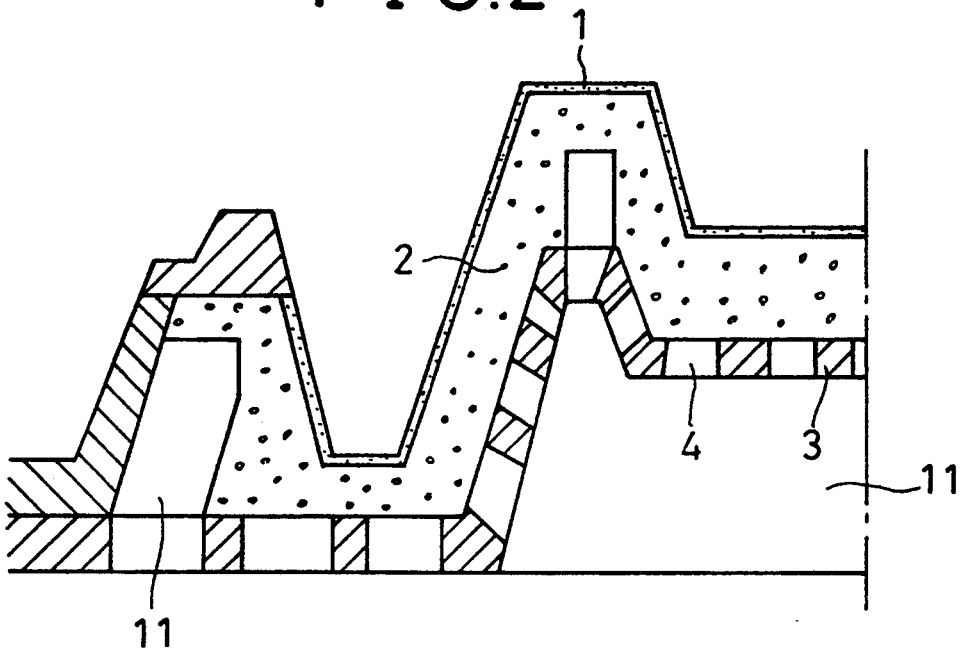
FIG. 2 is a lateral cross section of an embodiment of the pulp molding die according to the present invention in which both the porous molding layer and the porous support layer are composed of particles bonded together and the rigid body is integrated to the porous support layer.

FIGS. 2–5 show embodiments of the die of the invention in which the porous molding layer 1 and the porous support layer 2 are integrated to the rigid body 3. FIG. 2 shows an embodiment in which a support layer 2 is maintained by a rigid body 3 adhered to the porous support layer 2 from below.

Figure 3:
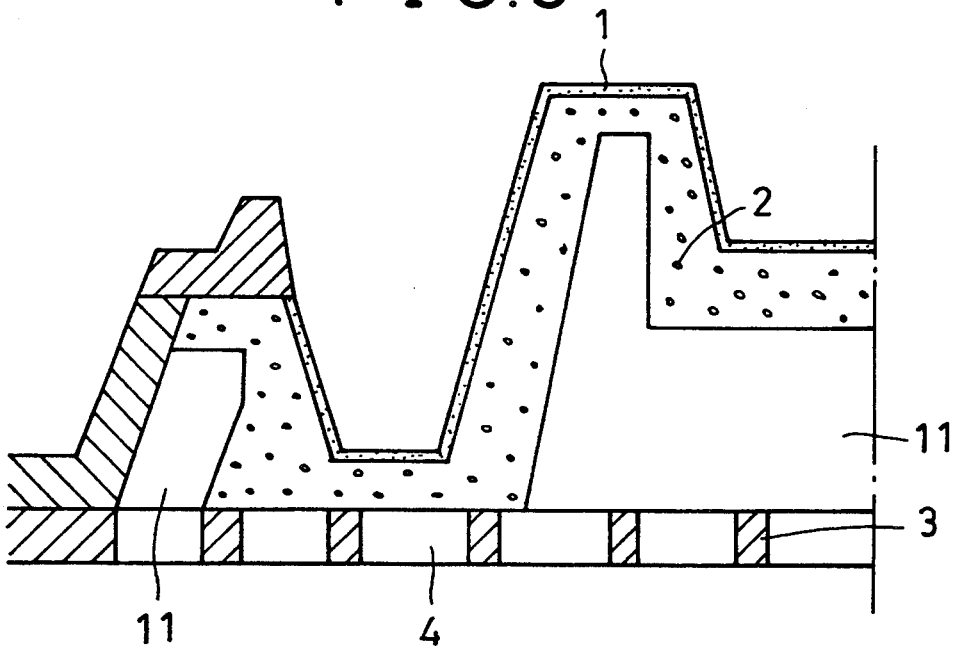
FIG. 3 is a lateral cross section of an embodiment of the pulp molding die according to the present invention in which both the porous molding layer and the porous support layer are composed of particles bonded together and the rigid body is integrated to the porous support layer.

FIG. 3 shows the die in which a rigid body 3 is a flat perforated plate, and some parts of the rigid body 3 do not contact the porous support layer 2, leaving some empty spaces between the porous support layer 2 and the rigid body 3. One of the empty spaces between the porous support layer 2 and the rigid body 3 is located at a center part of the rigid body.

Figure 4:
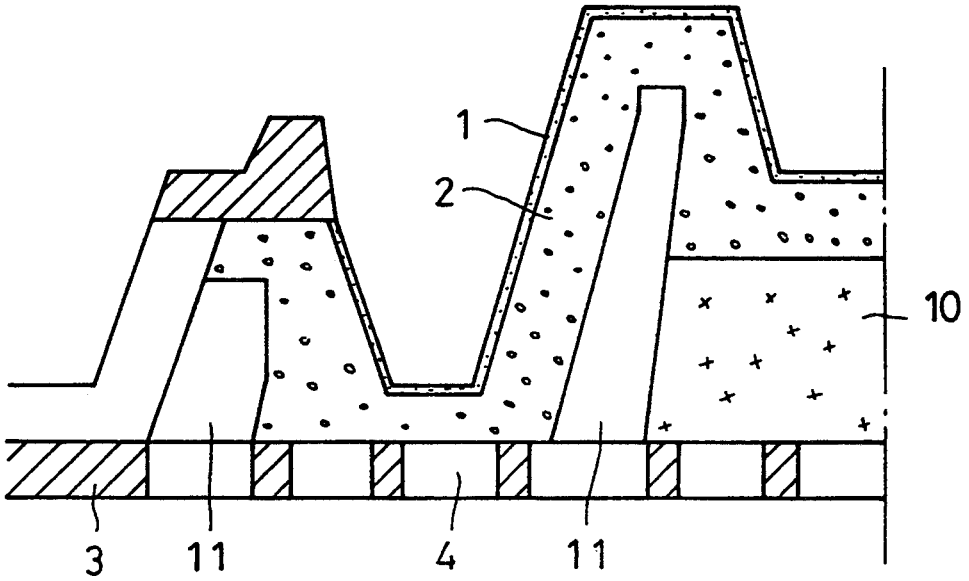
FIG. 4 is a lateral cross section of an embodiment of the pulp molding die according to the present invention in which both the porous molding layer and the porous support layer are composed of particles bonded together and the rigid body is integrated to the porous support layer.

FIG. 4 shows the die which modifies the die of FIG. 3. The die of FIG. 4 has a back-up layer 10 between the porous support layer 2 and the rigid body 3 in otherwise empty spaces in the molding die of FIG. 3. The back-up layer 10 may be composed of large particles, leaving enough pores for allowing sufficient flow of air or water.

Figure 5:
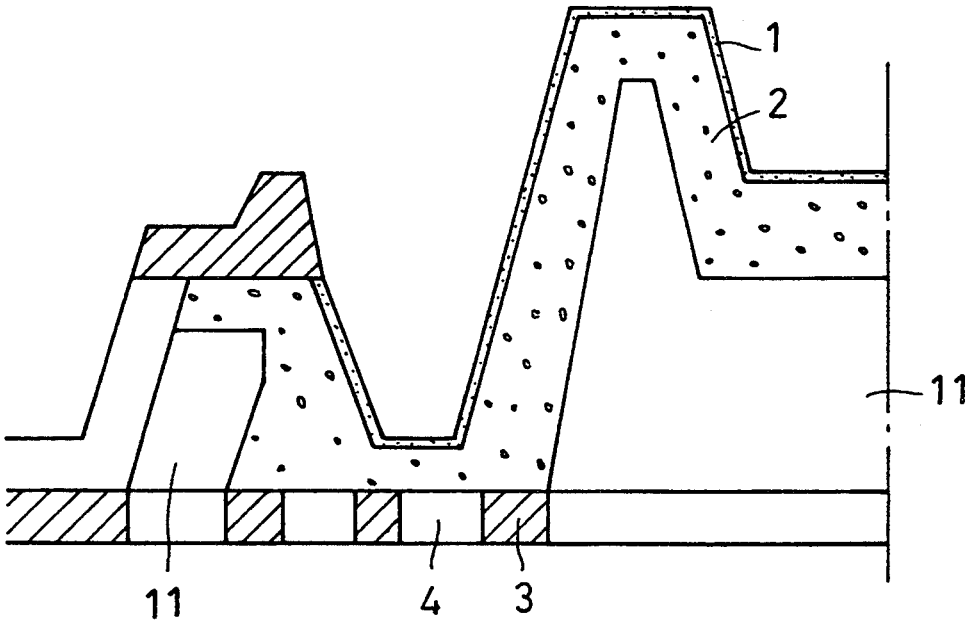
FIG. 5 is a lateral cross section of an embodiment of the pulp molding die according to the present invention in which both the porous molding layer and the porous support layer are composed of particles bonded together and the rigid body is integrated to the porous support layer.

FIG. 5 shows a structure that the rigid body 3 of the molding die shown in FIG. 3 does not stretch to its center part unlike that of FIG. 3. Reference numeral 11 indicates an empty space.

Figure 6A:
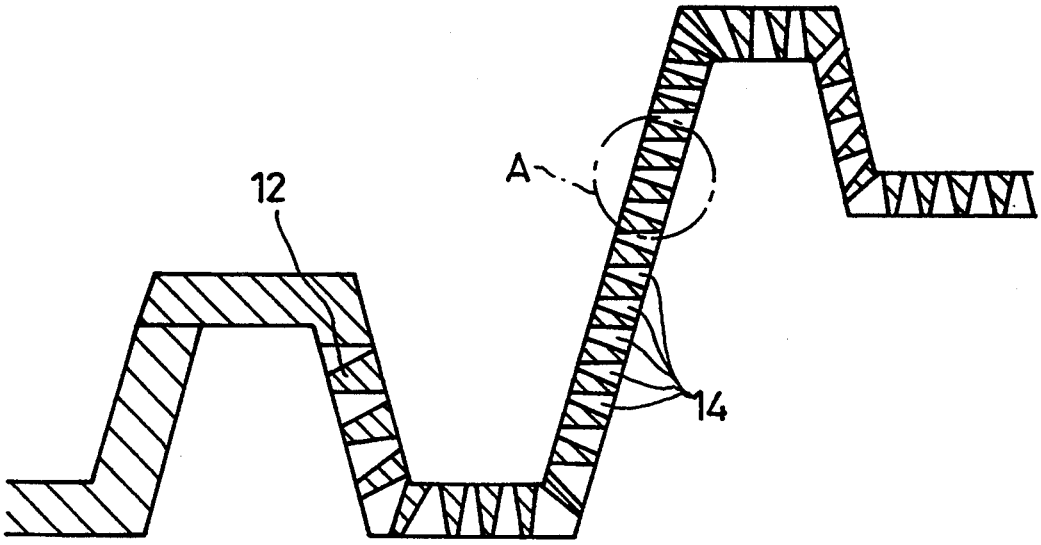
FIGS. 6(*a*), 6(*b*), and 6(*c*) are lateral cross sections of embodiments of the pulp molding die according to the present invention in which both the porous molding layer and the porous support layer are integrally formed by electroforming.
Figure 6B:
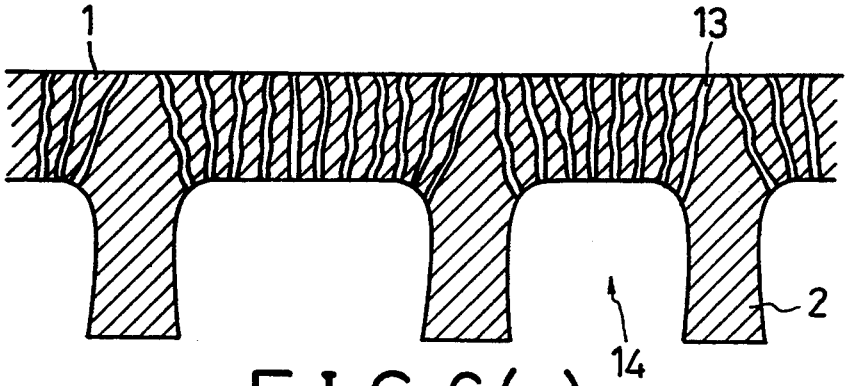
Figure 6C:
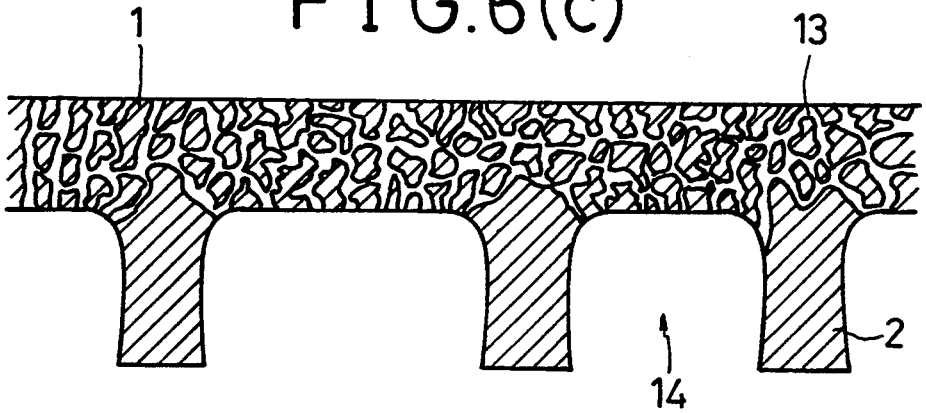
Figure 7:
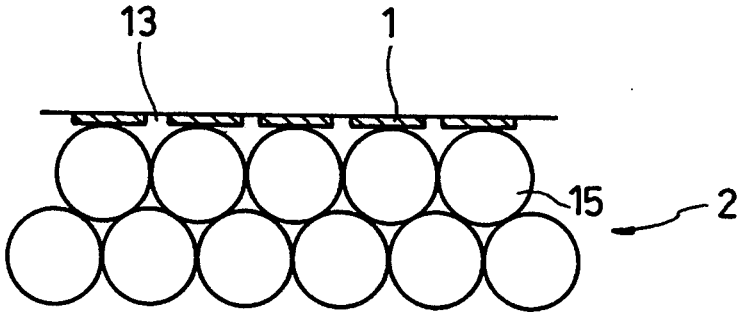
FIG. 7 is a lateral cross section of an embodiment of the pulp molding die according to the present invention in which the porous molding layer is formed by electroforming, and the porous support layer is composed of particles bonded together.
Figure 8:
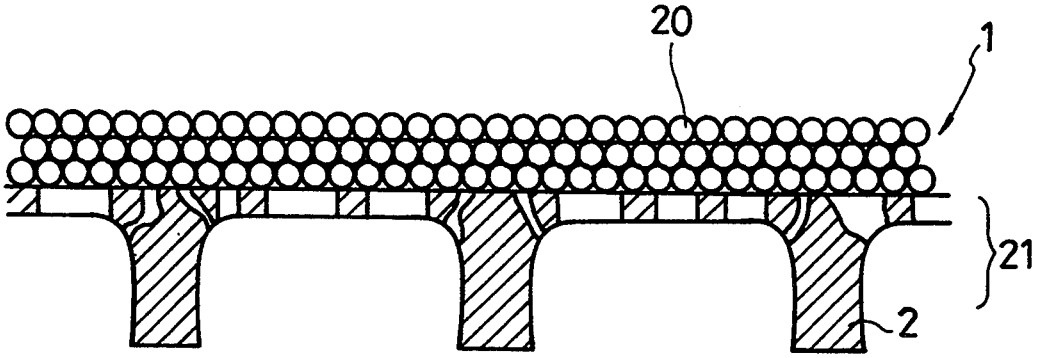
FIG. 8 is a lateral cross section of an embodiment of the pulp molding die according to the present invention in which the porous molding layer is composed of particles bonded together, and the porous support layer is formed by electroforming.

FIGS. 6(*a*), 6(*b*), 6(*c*), 7, and 8 show embodiments of the invention in which the porous molding layer 1 and/or the porous support layer 2 has a porous material 12 formed by electroforming. In FIGS. 6(*a*), 6(*b*), and 6(*c*) both molding layer 1 and support layer 2 are integrally formed by electroforming. The molding layer 1 has drains 13 having small apertures, and the supporting layer has drains 14 having large apertures. FIGS. 6(*b*) and 6(*c*) are cross sections that enlarge the A portion of FIG. 6 (*a*). In FIG. 7 molding layer 1 is formed by electroforming, and support layer 2 consists of particles 15 bonded by a bonding agent. In FIG. 8 molding layer 1 consists of particles 20 bonded by a bonding agent, and support layer 2 is a porous article 21 formed by electroforming. By electroforming metal is electrically deposited onto an article to be treated to form a part having a desired shape.

Figure 9A:
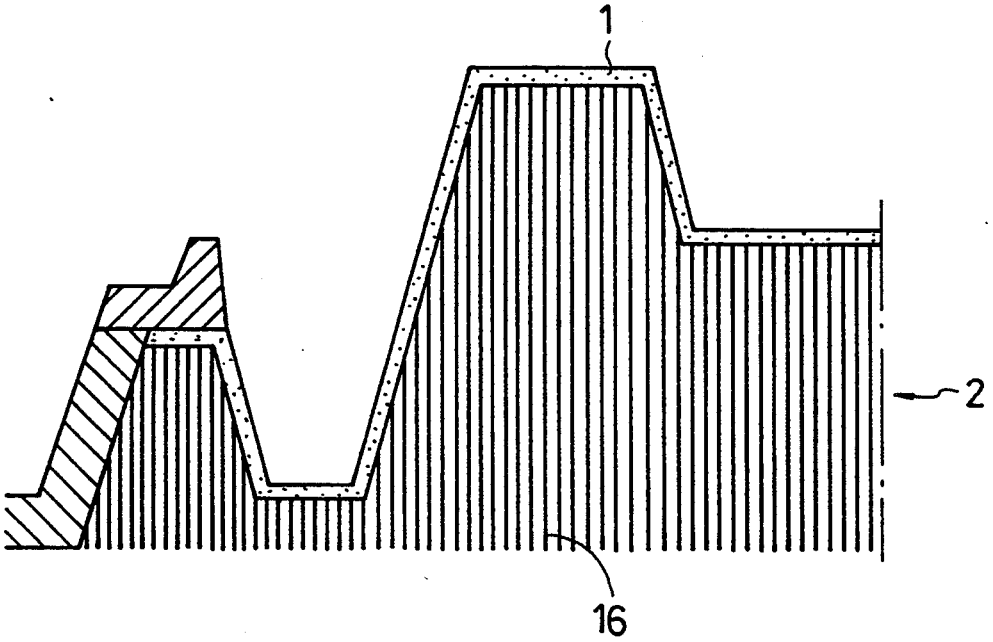
FIG. 9(*a*) is a lateral cross section of an embodiment of the pulp molding die according to the present invention in which the porous support layer is composed of a honeycomb structure.
Figure 9B:
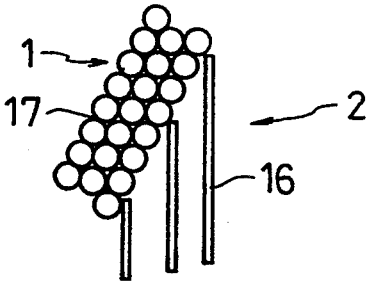
Figure 9C:
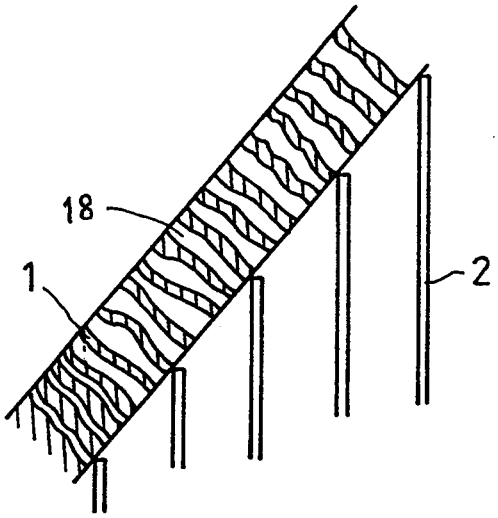

Alternatively the porous molding layer 1 and/or the porous support layer 2 may have a honeycomb structure. In FIG. 9 support layer 2 has a honeycomb structure 16. In FIG. 9(*b*) a molding layer 1 consists of particles 17, while in FIG. 9(*c*) a molding layer 1 consists of a porous article 18 formed by electroforming.

Figure 10A:
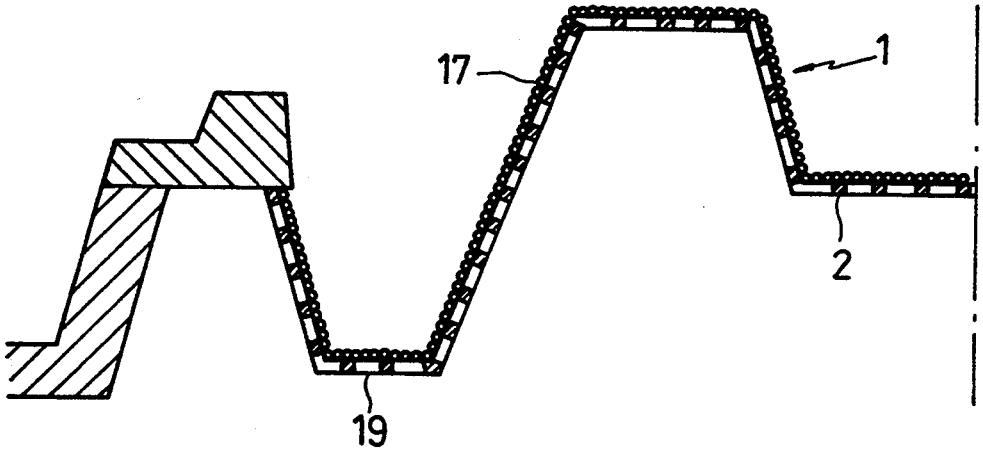
FIGS. 10(*a*) and 10(*b*) are lateral cross sections of an embodiment of the pulp molding die according to the present invention in which the porous molding layer is composed of particles bonded together, and the porous support layer is composed of a perforated metal.
Figure 10B:
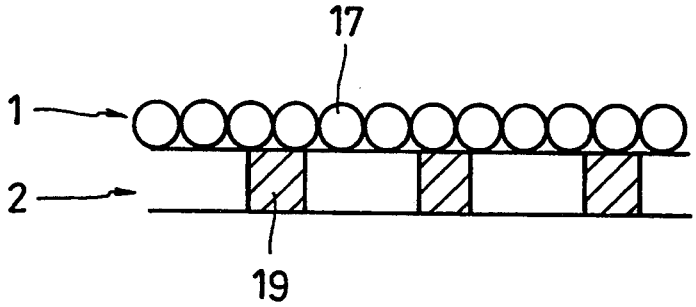

As alternative embodiments, the porous molding layer 1 and/or the porous support layer 2 may be formed as a perforated metal plate. In FIGS. 10(*a*) and 10(*b*) a molding layer consists of particles 17, and a support layer consists of a perforated metal plate 19.

A method of molding shaped pulp articles from fiber pulp is hereinafter described.

The method for molding pulp articles of the present invention is characterized by a backwash process. In the process after the step of molding a pulp article, cleaning water is applied to either the porous molding layer 1 or the porous support layer, or preferably both the porous molding layer 1 and the porous support layer 2 so as to incorporate water in their pores, followed by applying air pressure to the die from inside the molding die by, for example, a volume of pre-compressed air. By this process, water and air pass though the porous support layer and the porous molding layer and fibers, stuck in the porous molding layer through molding pulp articles, are blown away to outside of the molding die through the molding surface. In the backwashing process of the invention water and air are applied sequentially. Preferably water is applied to the molding surface of the porous molding layer 1 to incorporate water in the pores in the layers.

It is preferable that a pressure higher than atmospheric pressure is impulsively applied to the inside of the molding die in order to enhance the washing effect. The air pressure may be applied so as to give a maximum pressure at the molding surface of the die of at least 1.0 gf/cm$^2$, and, more preferably, at least 3.0 gf/cm$^2$. Though the pressure on the molding surface is preferably high, the air pressure to give a pressure at the molding surface of the die up to 500 gf/cm$^2$ is practical in view of enlargement of apparatus, the cost, and mechanical strength of the die. 1 gf is equivalent to $9.80665 \times 10^{-3}$N.

Preferably the air pressure is applied as an impulse which rises to 1.0 gf/cm$^2$ in less than 0.5 seconds. It is far effective in removing trapped fibers to apply the pressure as an impulse, more effective by applying pressure as repeated impulses.

This operation can be easily controlled by instantly opening the valve 26 for backwashing, while maintaining the pressure of, for example, at least several atmospheric pressures in the compression chamber 28. Preferably the air pressure is applied as an impulse by connecting the die to a volume of precompressed air.

Preferably the valve 26 for backwashing is an electromagnetic valve having a large capacity so that application of air pressure as an impulse is facilitated. For the same reason the volume of a compression chamber 11 is preferably much larger than that of the chamber of the molding apparatus 22. Likewise the larger the inner diameter of a conduit 33, the better.

A backwash process becomes more effective by the presence of a surfactant in the cleaning water. In addition to the backwashing process it is also preferable to wash a die in a conventional manner by applying a pressurized water to the molding surface of the die.

A backwash process in accordance with the present invention can be performed in a short period such as several seconds after a molding operation. Therefore, it does not waste time in the molding cycle, and the effect of washing is greater than that of conventional washing methods. It is most effective that the washing is performed in every molding operation. However, it is possible to perform washing once in every 5–10 molding operations when the shape of the molding die is simple or when the number of moldings is small.

By adopting the method having the washing process mentioned above, the molding die can be prevented from clogging without decreasing its productivity. Particularly, by using the molding die of the present invention and adopting the method of the present invention, the eminent effect of washing can be obtained, and at least thousands of continuous moldings without clogging become possible.

The molding die of the present invention has advantages such that: the die is not prone to clogging; the die gives a molded pulp article having a smooth surface; the die does not break after successive use; the mold can be prepared in a short period of time.

The method according to the present invention includes a backwash process in which pressure is applied from inside the die subsequent to molding operations so that continuous molding operations become possible without interruption due to clogging of the die. The present invention enables one to easily form pulp articles made of pulps from recyclable used papers in a large quantity.

EXAMPLES

The present invention is hereinafter described in more detail with reference to Examples. However, the present invention is not limited to these Examples.

Figure 11:
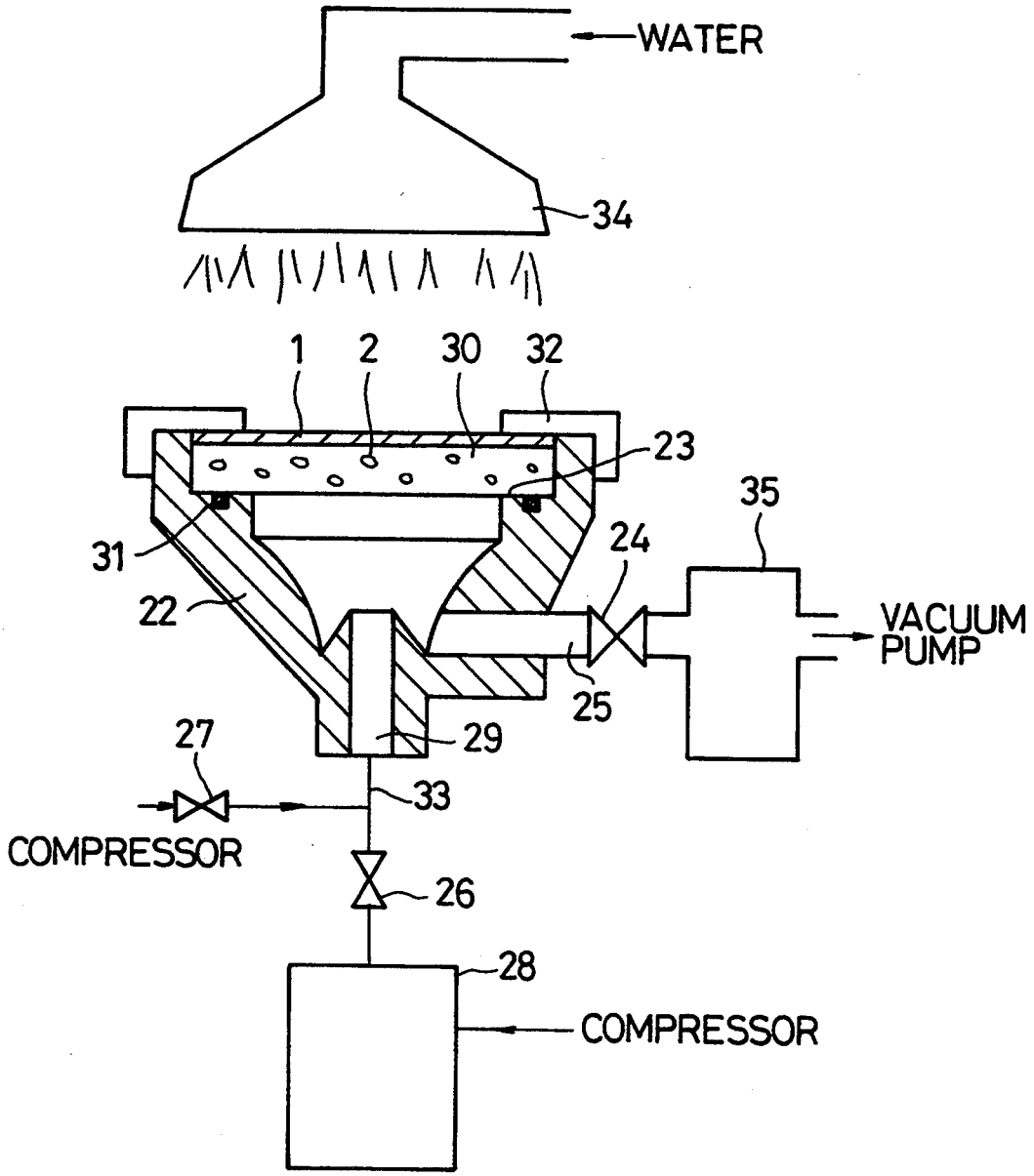
FIG. 11 is a lateral cross section of an embodiment of the pulp molding apparatus according to the present invention.

FIG. 11 shows a molding die 30 consisting of a molding layer 1 and a support layer 2, and the molding die 30 has a shape of a disk having a diameter of 140 mm and a height of 25 mm. Both the porous molding layer 1 and the porous support layer 2 are composed of glass beads having sphere shapes bonded by a water-resistant epoxy resin. To form the mold layer 1, 8.7% by volume of the epoxy resin was used, while to form the support layer 1, 6.6% by volume of the epoxy resin was used. The porosity, the average pore diameter and the thickness of the porous molding layer 1 and the porous support layer 2 were chosen for each Example.

The apparatus for molding shaped pulp articles from fiber pulp is shown in FIG. 11. A metallic chamber unit 22 has a holder 23 for holding a molding die 30, and drains 25, 29. The drain 25 for water and air is connected to a vacuum pump by means of a valve 24 and a vacuum chamber 35.

The drain 29 is connected to a compression chamber, that is, a container 28 for compressed air, by means of a pressure valve 26 for backwashing. The drain 29 is connected to a pressure valve 27 for removing a deposit cake. A compression chamber 28 was set to 1 kgf/cm$^2$ (a gauge pressure).

The molding die 30 was mounted to the chamber unit 22 through a packing 31 by means of a lid 32 for pressing the die. The valve 24 disconnects a chamber inside the chamber unit 22 from the vacuum chamber 35. When the valve 24 is open, a pressure in the chamber inside the chamber unit decreases so as to suck a slurry containing fibers and to deposit fibers on the molding surface of the molding die 30. After a slurry is removed, opening the valve 24 dries the resulting fibrous deposit cake on the molding die.

The valve 27 for removing a deposit cake has been closed in these steps to disconnect the chamber inside the chamber unit 22 from the compressed air provided by a compressor. Opening the valve 27 applies an air pressure to the chamber inside the chamber unit 22 to remove the fibrous deposit cake from the molding surface of the molding die 30.

After removing the pulp article every time, water is showered over the molding surface of the molding die by a shower 34, disposed above the molding die 30, so as to incorporate water in pores in the die 30.

A pressure valve 26 for backwashing has been closed in these steps, and disconnects the chamber inside the chamber unit 22 from pre-compressed air in the container 28 for compressed air. Opening the pressure valve 26 provides a large volume of pre-compressed air to the chamber inside the chamber unit 22 so as to backwash the molding die 30. Thus the air passes through the die 30 in the direction of the molding surface, driving the incorporated water from the die The vacuum chamber 35 was kept under a pressure below 60 mm Hg. The container 28 for compressed air was kept at about one atmospheric pressure.

The slurry used in this molding operation is prepared as follows. A pulp was made from the equal amount by weight of used newspapers and card boxes, and the pulp is dispersed in water to give the slurry containing 1% by weight of the pulp.

Using this molding apparatus, a molding cycle consisting of eight steps shown in Table 1 was continuously repeated. It took about 20 seconds to complete each cycle.

(TABLE 1)

| |
|---|
| (1) A molding die is immersed into a slurry containing fibrous pulp. It takes one second to complete this step. |
| (2) A vacuum valve 24 opens so as to reduce pressure in the chamber to deposit pulp on a molding surface of the die. It takes 1 to 3 second to complete this step. |
| (3) The molding die is taken out of the slurry, keeping the valve 24 open to dry the deposit through suction of air. It takes thirteen seconds to complete this step. |
| (4) The vacuum valve 24 is closed |
| (5) The compression valve 27 is open so as to remove the deposit from the molding die. It takes two seconds to complete this step. |
| (6) Water is showered over the molding surface for one second. |
| (7) The pressure valve 26 opens. |
| (8) The pressure valve 26 is closed. It takes two seconds to open and close the pressure valve 26 once. |
| (9) Go back to the step 1. |

A method for obtaining air flow characteristic of a molding die is described hereinafter.

Figure 12:
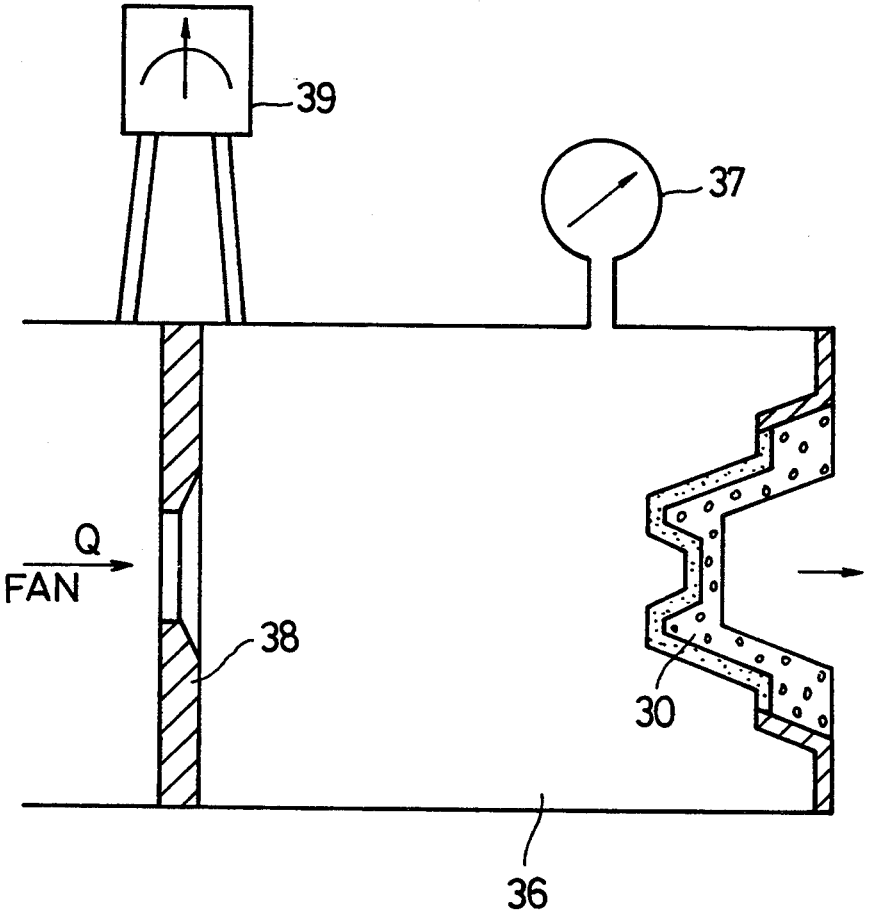
FIG. 12 is a permeability measuring apparatus.

A molding die 30 was tested for its air flow characteristic which correlates air pressures applied to the die and air flow through the die. After a die in the molding apparatus underwent every 100 molding cycles, the die was taken out of the molding apparatus, and a molding die was dried by a dryer. Then the correlation of the die was measured by the permeability measuring apparatus shown in FIG. 12.

The permeability measuring apparatus has a wind channel 36 to which a molding die 30 can be attached airtight. The molding surface of the molding die faces against the air flow. The apparatus has a pressure gauge 37 for measuring a pressure of the upstream of the molding die 30, i.e. a pressure at the molding surface. The apparatus further includes an orifice plate 38 having an orifice, a differential pressure gauge 39, and a fan (not shown).

A method for obtaining a "permeability ratio" is described hereinafter.

As molding operations are repeated by the molding apparatus, a molding die 30 loses its permeability due to an increased amount of fibers trapped in the die. A "permeability ratio" is defined as a parameter to indicate permeability of air through the die or, to be more exact, the extent of clogging of the die after repeated molding operations.

The permeability ratio is defined as follows:

the permeability ratio (%)=[Qx/Qi]×100 wherein

Qi is an initial air flow though a fresh die before a molding operation under an air pressure difference through the die of 300 mm Aq; and Qx is an air flow through the die after its successive molding operations of x times when an air pressure of 300 mm Aq is applied to the die;

wherein 1 mmAq is equivalent to a pressure exerted by a pure water having a height of 1 mm under gravity, and usually x is 600.

Since the ratio of air flows of the same die is taken, the effect on permeability due to its porosity, thickness, etc. would be cancelled out. Thus the loss of permeability during repeated molded operations of a die can be compared by this permeability ratio to another die.

A "required molding time" is defined as a parameter to indicate permeability of water though a molding die. When a molding die is used to mold a pulp article of a certain thickness from a slurry, it takes time to deposit pulp fibers through suction, and the time depends on permeability of water through the molding die. In each of the examples described hereinafter, a time required to mold a disk shape pulp article having a diameter of 120 mm and a thickness of 3 mm is defined as a "required molding time."

A porosity and an average pore diameter of the porous molding layer and the porous support layer is described hereinafter.

Both an apparent specific gravity and a true specific gravity of a layer were measured and a porosity of the layer was calculated based on the two values.

An average pore diameter and a pore diameter distribution were determined in the following three steps.

In the first step a magnified photograph showing pores were taken of any part of the molding surface or any cross section of the porous molding layer and the porous support layer. However, when a layer consists of particles, sometimes it is difficult to take such a clear magnified photograph showing pores for water and air passage of the layer. On such occasions from the molding surface or from the surface of the cross section, particles appeared on the surfaces were removed so that pores were clearly recognized. Then the photograph on the surface was taken.

In the second step pores in the photograph were painted black while the other parts were painted white to form a white-and-black pattern. The pores were defined as empty spaces among the particle on the utmost surface in the magnified photograph.

In the last step the white-and-black pattern was treated with picture analysis so that a black pattern was approximated to circles. Then an average of the diameters of the circles was taken as an average pore diameter, and a distribution of the diameters of the circles was taken as a distribution of the pore diameters.

Alternatively mercury porosimetry may be applied to the porous molding layer and the porous support layer having an average pore diameter up to 300 μm.

EXAMPLE 1

The porous molding layer 1 of the die of this Example had a porosity of 40% and a thickness of 4 mm. The porous support layer 2 had a porosity of 40%, an average pore diameter of 1.2 mm, and a thickness of 16 mm.

Figure 13:
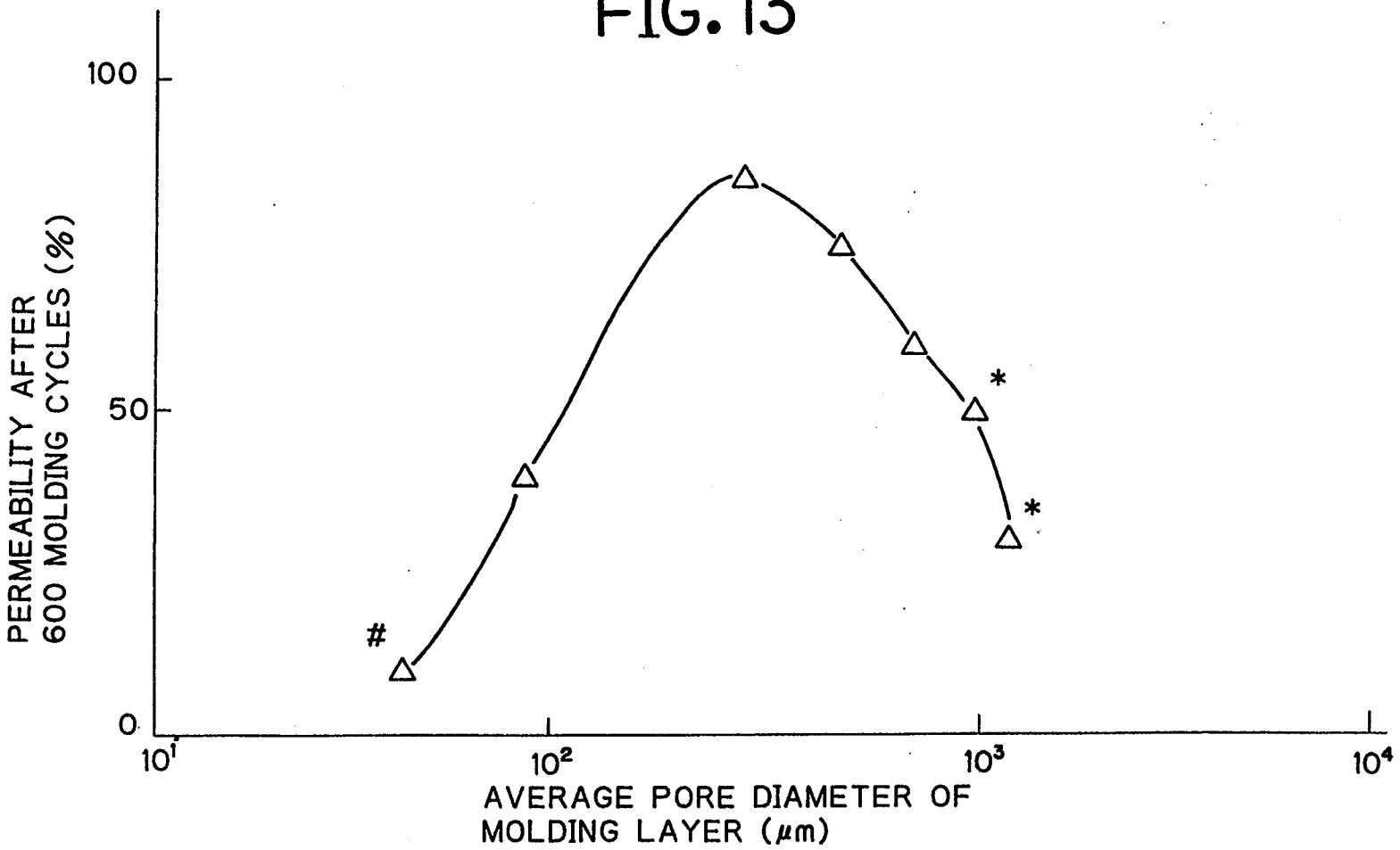
FIG. 13 is a graph correlating the permeability ratio and average pore diameters of the porous molding layer of Example 1.

The average diameter of the pores of the porous molding layer 1 was taken as a variable, and the permeability ratio, $Q_{600}/Qi$, of dies were obtained. The result is shown in FIG. 13.

The die having the average pore diameter of the porous molding layer 1 of about 20 μm, was clogged after molding operations were repeated 100 times. Thus, the permeability ratio (%) on this point is taken as a ratio of $Q_{100}$ over Qi wherein $Q_{100}$ is the air flow at 300 mmAq after molding pulp articles 100 times with the die.

The dies having their average pore diameters of the molding die of about 500 μm and 600 μm were clogged after 300 successive molding operation. Thus, the permeability ratio (%) on these point are taken as ratios of $Q_{300}$ over Qi wherein $Q_{300}$ is the air flow at 300 mmAq of the die after 300 successive molding operation.

EXAMPLE 2

The porous molding layer 1 of the die of this Example had a porosity of 40%, an average pore diameter of 480 μm, and a thickness of 4 mm. The porous support layer 2 had a porosity of 40% and a thickness of 16 mm.

Figure 14:
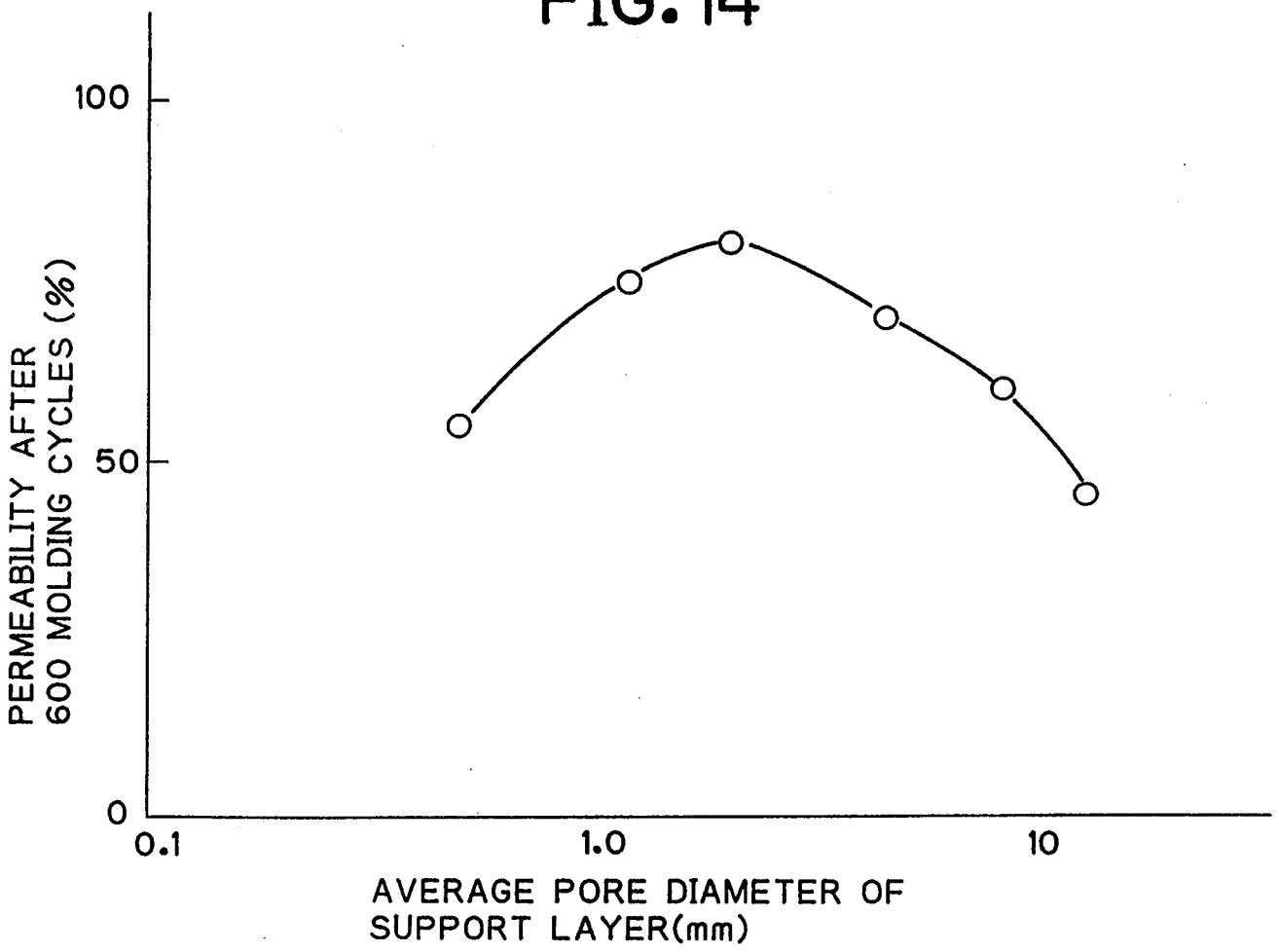
FIG. 14 is a graph correlating the permeability ratio and average pore diameters of the porous support layer of Example 2.

The average diameter of the pores of the porous support layer 2 was taken as a variable. The other conditions were kept the same as those of Example 1. The permeability ratio, $Q_{600}/Qi$, of dies were obtained. The result is shown in FIG. 14.

EXAMPLE 3

The porous molding layer 1 of the die of this Example had a porosity of 40% and a thickness of 4 mm. The porous support layer 2 had a porosity of 40% and a thickness of 16 mm.

Figure 15:
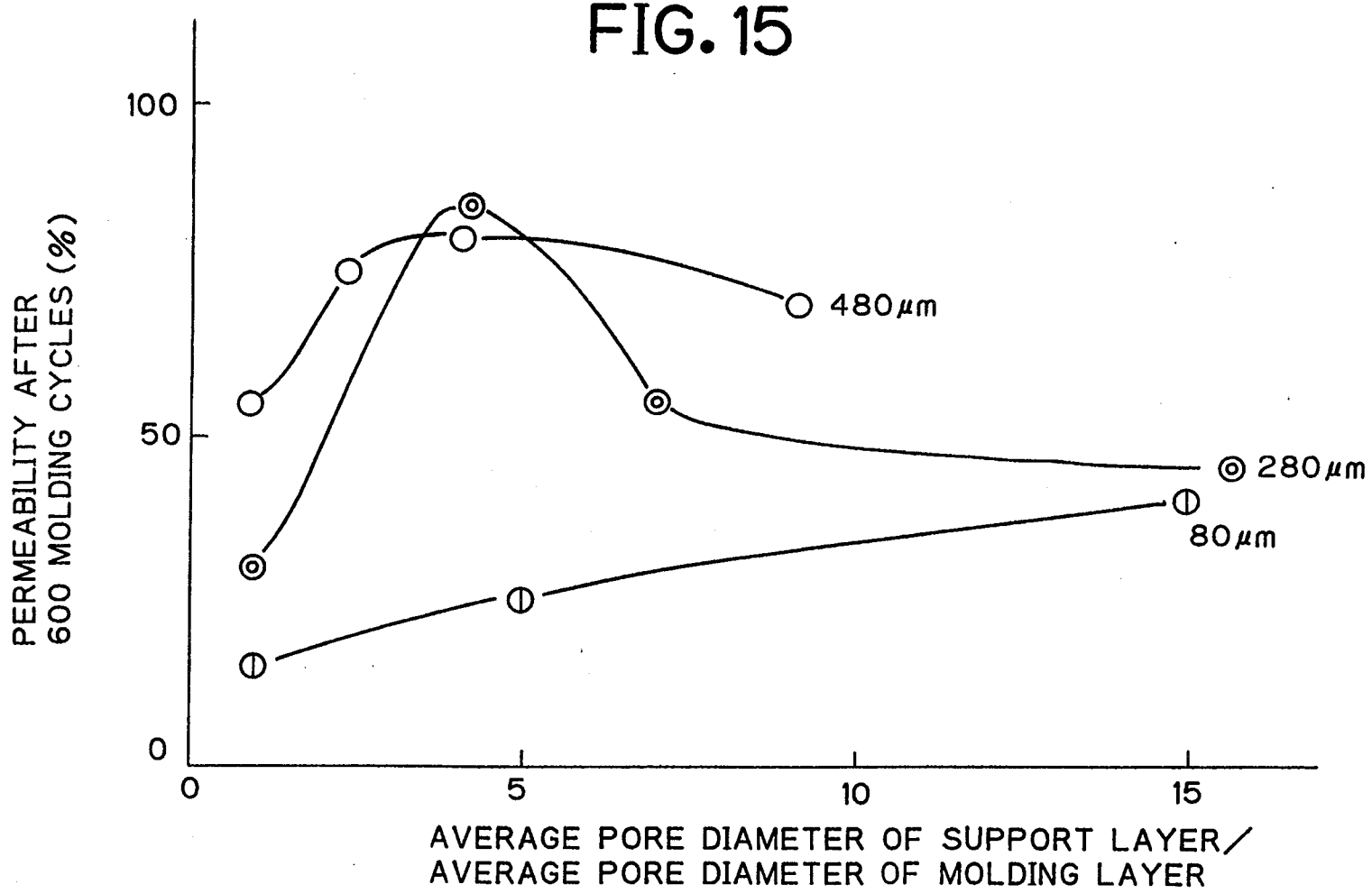
FIG. 15 is a graph correlating the permeability ratio and the ratio of average pore diameters of the porous support layer over average pore diameters of the porous molding layer of Example 3.
Figure 16:
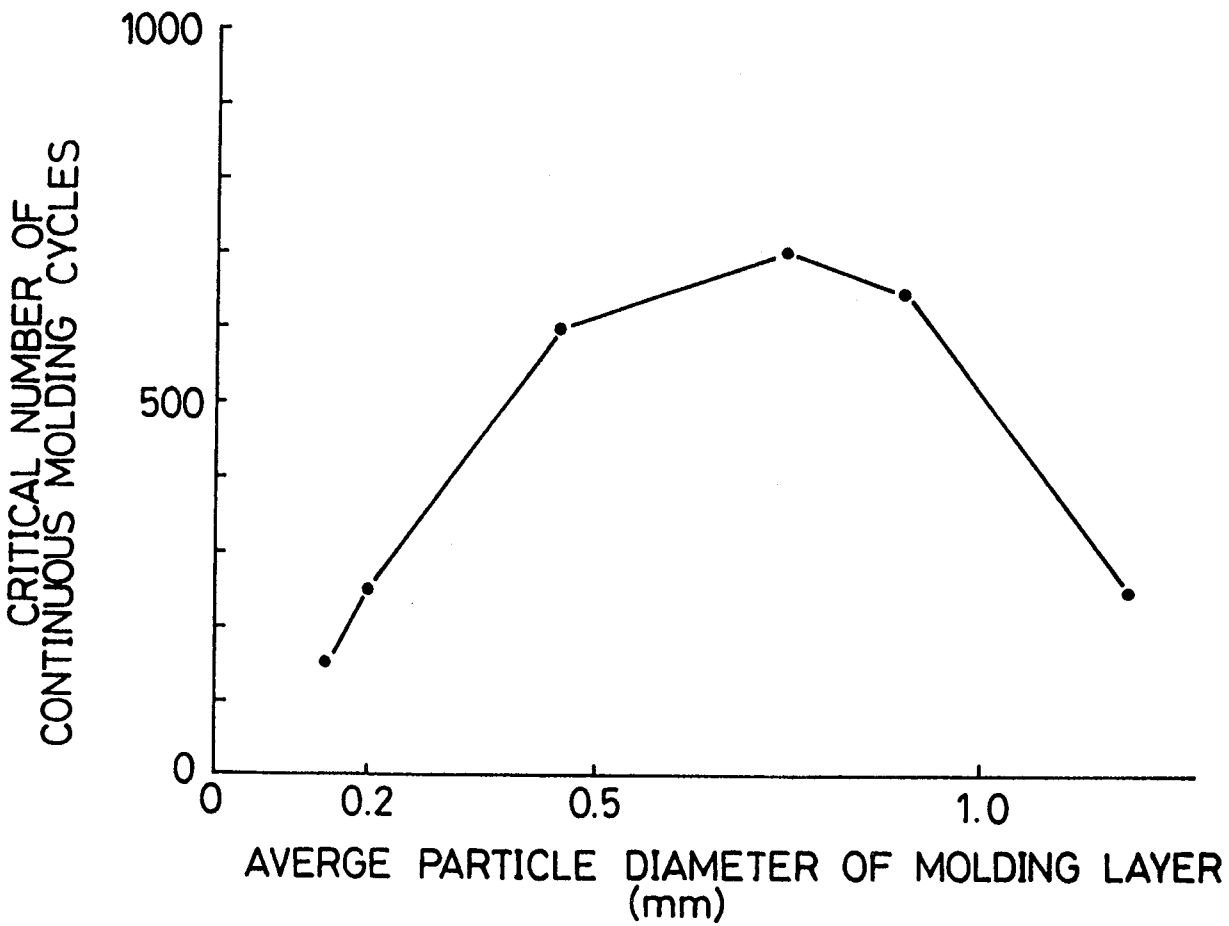
FIG. 16 is a graph correlating a number of continuous molding cycles and average diameters of particles for the porous molding layer of EXAMPLE 10.
Figure 17:
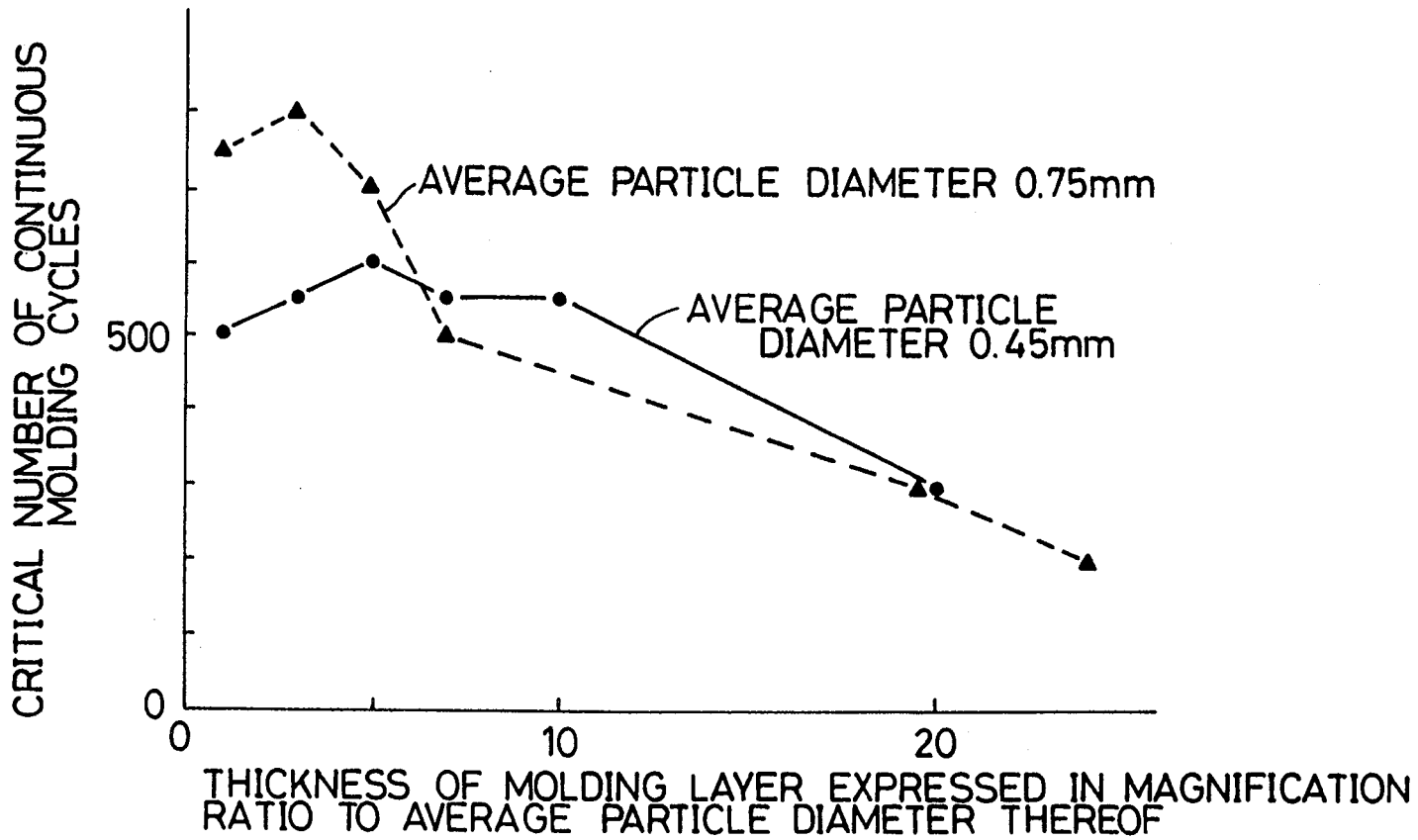
FIG. 17 is a graph correlating a number of continuous molding cycles and a thickness of the porous molding layer expressed in terms of magnification ratio to average particle diameters thereof of EXAMPLE 10.
Figure 18:
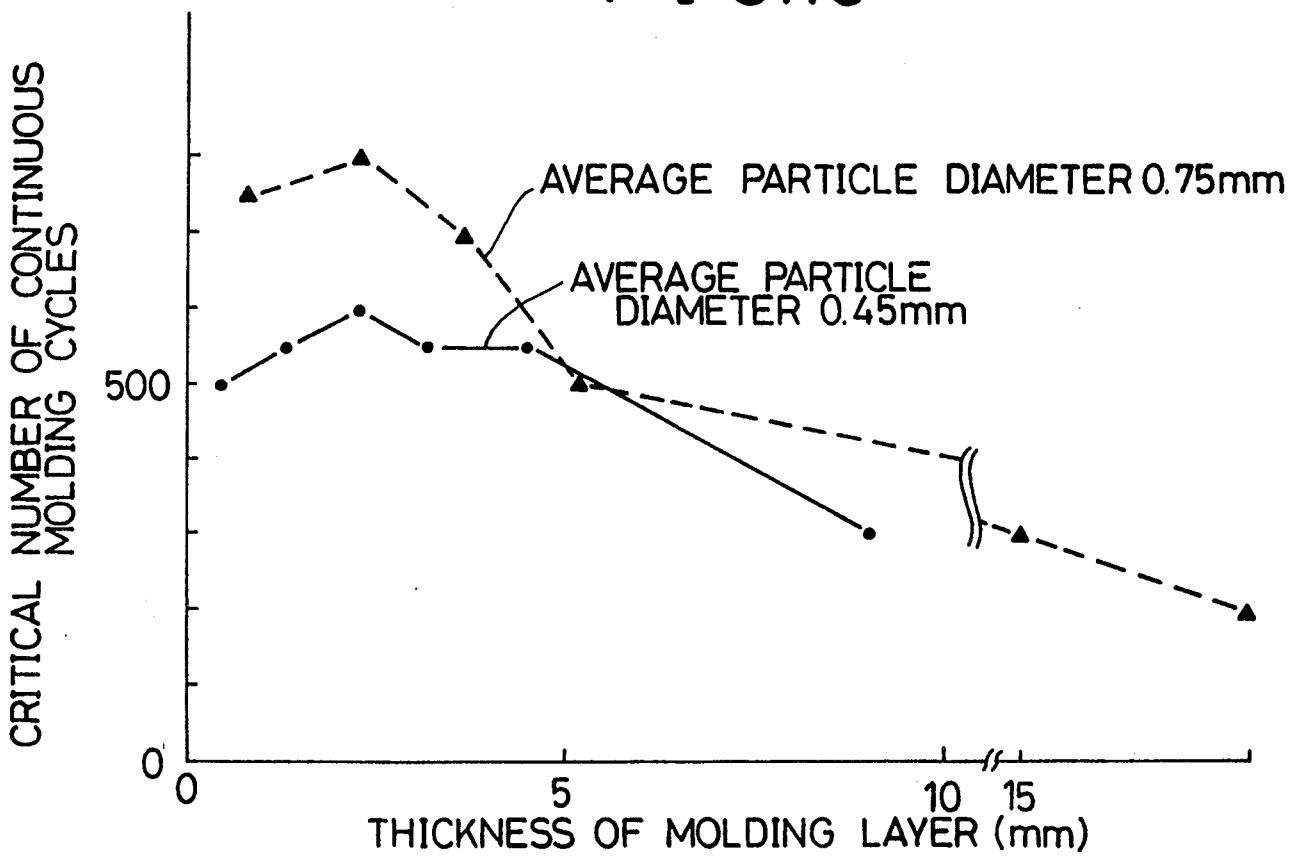
FIG. 18 is a graph correlating a number of continuous molding cycles and a thickness of the porous molding layer of EXAMPLE 10.
Figure 19:
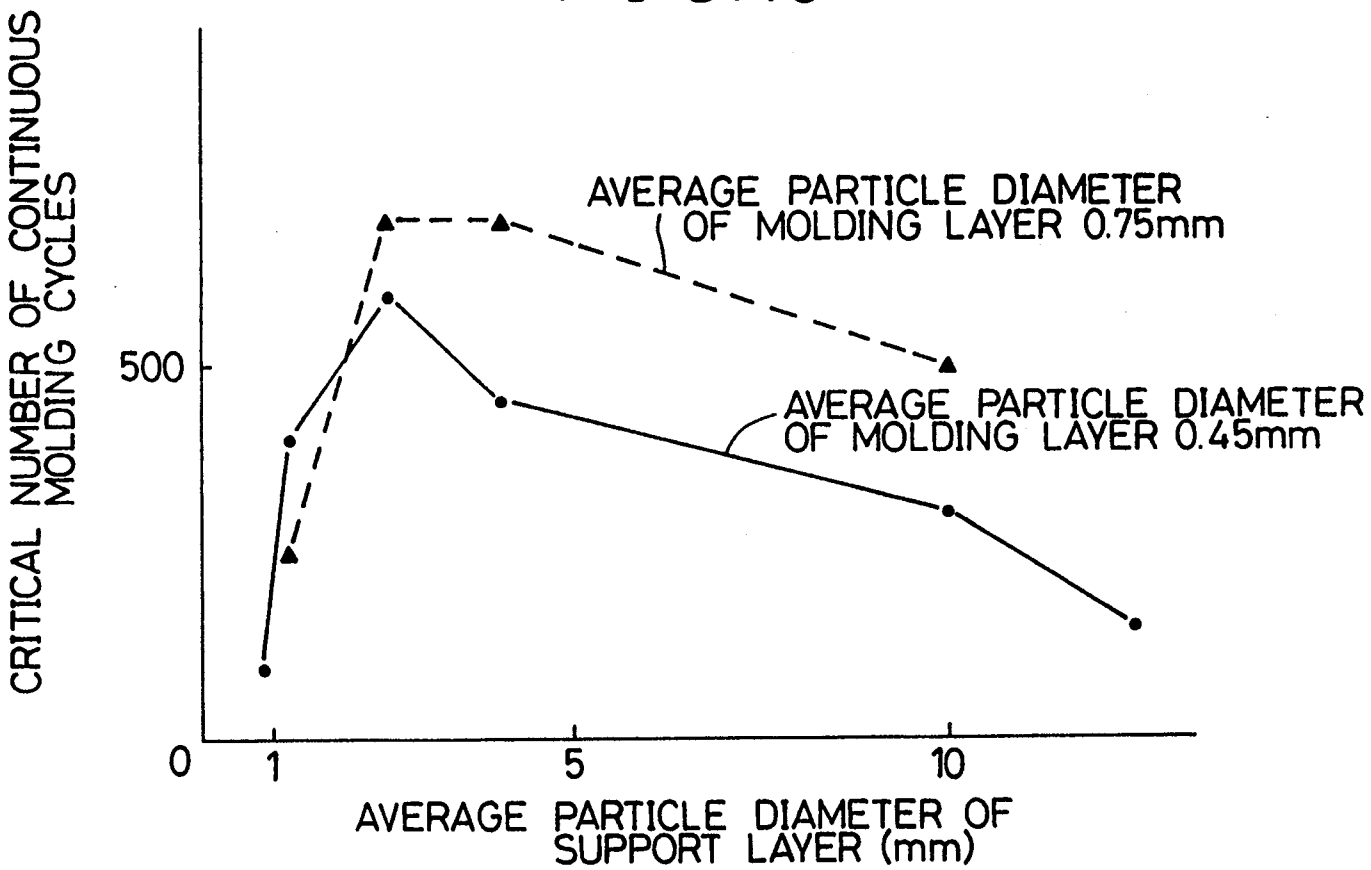
FIG. 19 is a graph correlating a number of continuous molding cycles and the average diameter of the particles for the porous support layer of EXAMPLE 10.
Figure 20:
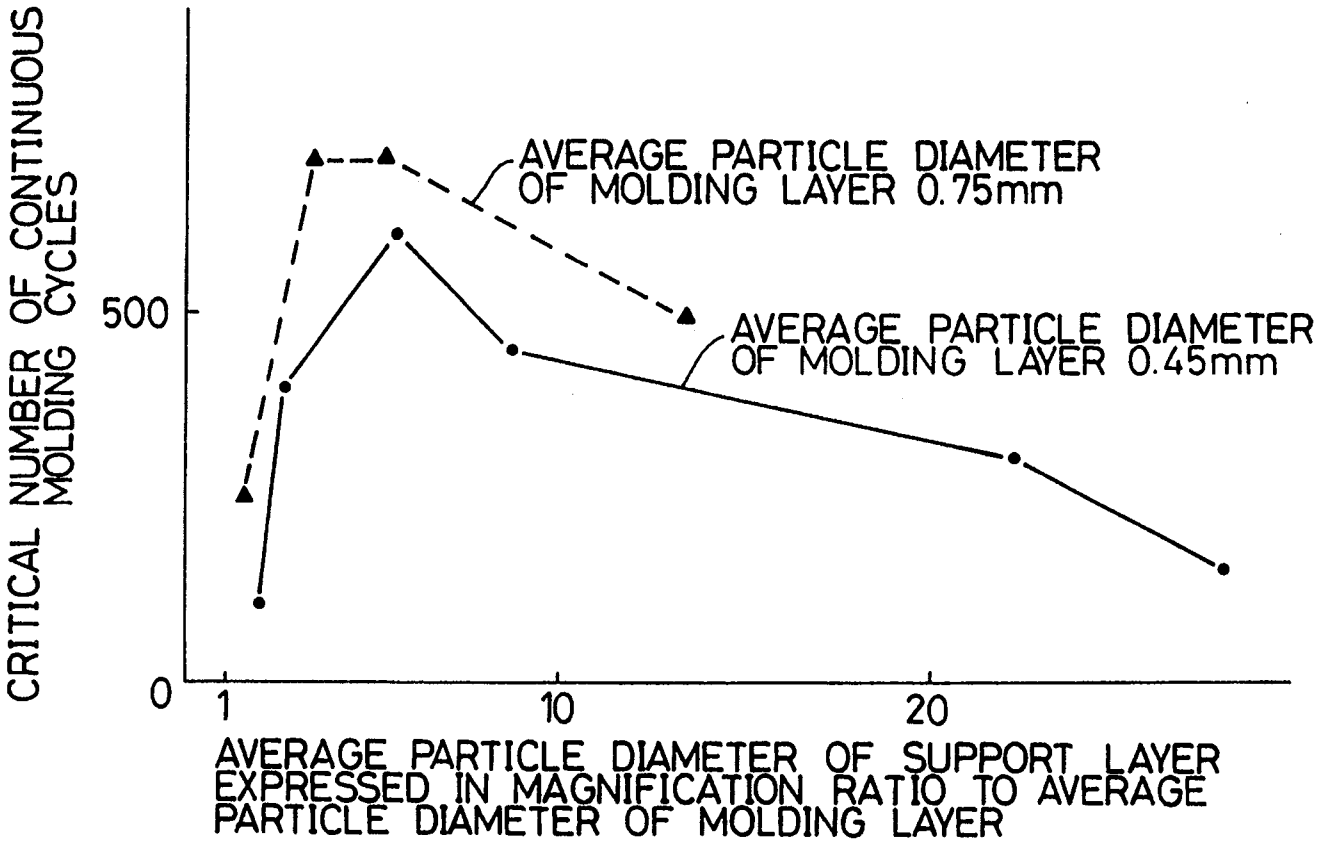
FIG. 20 is a graph correlating a number of continuous molding cycles and a thickness of the porous support layer expressed in terms of magnification ratio to average particle diameters thereof of EXAMPLE 10.
Figure 21:
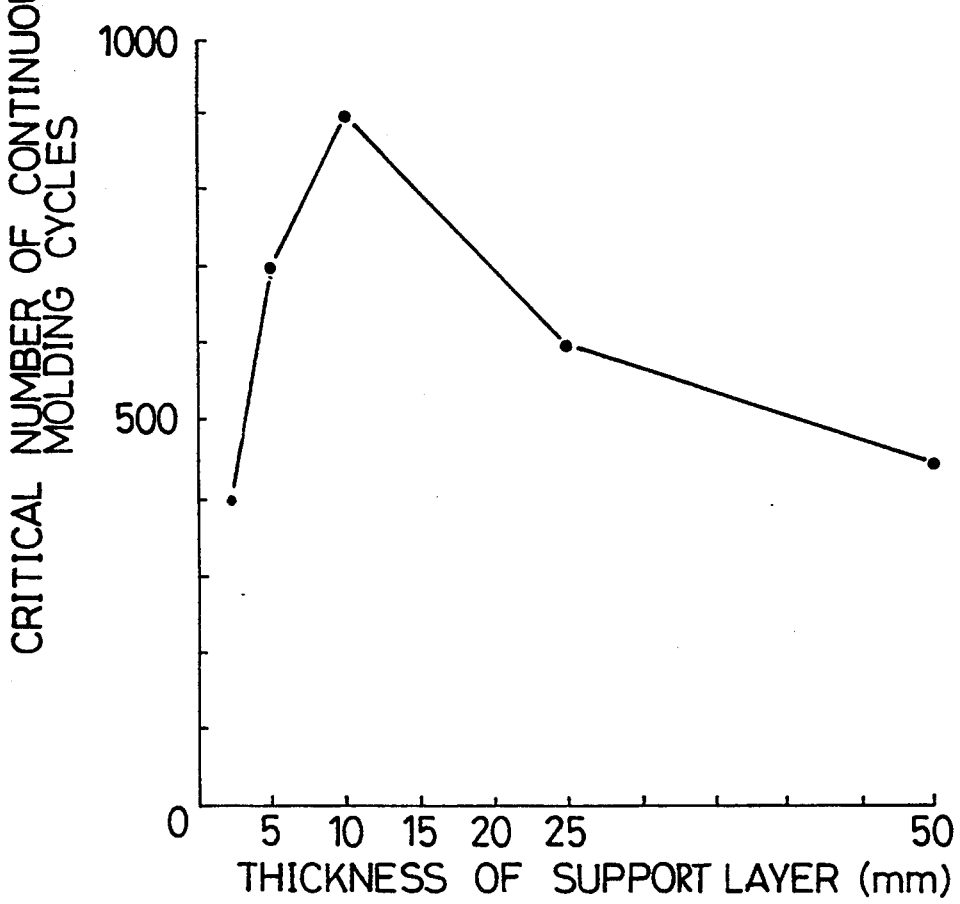
FIG. 21 is a graph correlating a number of continuous molding cycles and the thickness of the porous support layer of EXAMPLE 10.

The average pore diameter of the porous molding layer 1 was taken as 80, 280, and 480 μm. The other conditions were kept the same as those of Example 1. For each average pore diameter, average pore diameters of the porous support layer were varied, and the permeability ratio, $Q_{600}/Qi$, is plotted against the ratio of average pore diameters of the porous support layer over average pore diameters of the porous molding layer. The result is shown in FIG. 15.

EXAMPLE 4

The porous molding layer 1 of the die of this Example had an average pore diameter of 280 μm and a thickness of 4 mm. The porous support layer 2 had a porosity of 40%, an average pore diameter of 1.2 mm, and a thickness of 16 mm. A porosity of the porous molding layer was taken as a variable. The other conditions were kept the same as those of Example 1.

A "required molding time" was measured to deposit pulp fibers to mold a disk shape pulp article having a diameter of 120 mm and a thickness of 3 mm. The result is tabulated in Table 2.

(TABLE 2)

| porosity of molding layer (%) | a required molding time (seconds) |
|---|---|
| 3 | — |
| 12 | 15 |
| 38 | 3 |
| 59 | 1.5 |

When a die having a porosity of the porous molding layer of 3% is used, even after 30 seconds the deposit cake did not reach to a thickness of 3 mm.

EXAMPLE 5

The porous molding layer 1 of the die of this Example had an average pore diameter of 280 μm a porosity of 40%, and a thickness of 4 mm. The porous support layer 2 had an average pore diameter of 1.2 mm and a thickness of 16 mm. A porosity of the support layer was taken as a variable. The other conditions were kept the same as those of Example 1.

A "required molding time" was measured to deposit pulp fibers to mold a disk shape pulp article having a diameter of 120 mm and a thickness of 3 mm. The result is tabulated in Table 3.

(TABLE 3)

| porosity of support layer (%) | a required molding time (seconds) |
|---|---|
| 18 | 15 |
| 26 | 7 |
| 42 | 3 |

EXAMPLE 6

The molding layers 1 of the dies of runs No. 1–4 of this Example had a thickness of 4 mm, and the porous support layer 2 a thickness of 16 mm. The average pore diameters and porosities of the porous molding layer and the support layer were varied as in Table 4. The other conditions were kept the same as those of Example 1.

The die of run No. 5 is a conventional type as a comparative example in which a metallic net, as the porous molding layer is disposed on an aluminum plate with a thickness of 12 mm having apertures.

The permeability ratio, $Q_{600}/Qi$, of dies were obtained, and the result is shown in Table 4.

The die of run No. 1 was clogged after molding operations were repeated 250 times. Thus, the permeability ratio (%) of the die is taken as a ratio of $Q_{250}$ over Qi wherein Qi ($ml/cm^2.s$) is an initial air flow though a fresh die before a molding operation when an air pressure of 300 mm Aq is applied to the die and; $Q_{250}$ is an air flow through the die after its successive molding operations of 250 times when an air pressure of 300 mm Aq is applied to the die.

The die of run No. 5 uses a die of a conventional wire-mesh type in which a wire net serves as a molding layer and a main body composed of aluminum blocks serves as a support layer.

(TABLE 4)

| | molding layer | | support layer | | flow rate | |
|---|---|---|---|---|---|---|
| | average pore diameter (μm) | porosity (%) | average pore diameter (mm) | porosity (%) | Qi | $Q_{600}$/Qi |
| 1 | 60 | 40 | 0.4 | 40 | 47 | — |
| 2 | 200 | 40 | 1.2 | 40 | 138 | 60 |
| 3 | 280 | 40 | 1.2 | 40 | 218 | 85 |
| 4 | 480 | 40 | 1.2 | 40 | 279 | 75 |
| 5 | 560 | 70 | 3.0 | 15 | 628 | 50 |

EXAMPLE 7

The porous molding layer 1 of the die of this Example had an average pore diameter of 280 μm and a porosity of 40%. The porous support layer 2 had an average pore diameter of 1.2 mm, a porosity of 40%, and a thickness of 16 mm. A thickness of the molding layer was taken as a variable. The other conditions were kept the same as those of Example 1. The permeability ratio, $Q_{600}/Qi$, of dies were obtained. The result is tabulated in Table 5.

(TABLE 5)

| thickness of molding layer (mm) | the permeability ratio $Q_{600}/Qi$ (%) |
|---|---|
| 0.05 | — (broken after 200 times) |
| 0.20 | 90 |
| 5 | 75 |
| 15 | 50 |
| 25 | 35 |

EXAMPLE 8

The porous molding layer 1 of the die of this Example had an average pore diameter of 280 μm, a porosity of 40%, and a thickness of 4 mm. The porous support layer 2 had an average pore diameter of 1.2 mm, a porosity of 40%, and a thickness of 16 mm. A thickness of the molding layer was taken as a variable.

The percentage by volume of the pores of the porous molding layer having pore diameters in the range of 25% less than the average pore diameter thereof to 25% more than the average pore diameter thereof, was taken as a variable. The other conditions were kept the same as those of Example 1. The permeability ratios, $Q_{600}/Qi$, of dies was obtained. The result is tabulated in Table 6.

(TABLE 6)

| the pores of the porous molding layer having pore diameters in the range 25% less than the average pore diameter thereof to 25% more than the average pore diameter thereof (%) | permeability ratio $Q_{600}/Qi$ (%) |
|---|---|
| 70 | 75 |
| 85 | 85 |
| 95 | 90 |

EXAMPLE 9

The porous molding layer 1 of the die of this Example had an average pore diameter of 280 μm, a porosity of 40%, and a thickness of 4 mm. The porous support layer 2 had an average pore diameter of 1.2 mm, a porosity of 40%, and a thickness of 16 mm.

An air pressure to the die during a backwash step was varied to give a varied maximum pressure of the molding surface of the die, and the other conditions were kept the same as those of Example 1. The permeability ratios, $Q_{600}/Qi$, of dies were obtained. The result is tabulated in Table 7.

(TABLE 7)

| maximum pressure of the molding surface (gf/cm$^2$) | permeability ratios $Q_{600}/Qi$ (%) |
|---|---|
| 0.8 | 45 |
| 1 | 50 |
| 3 | 60 |
| 30 | 85 |

EXAMPLE 10

Numbers of successive 20-second cycles of molding operations of Table 1, using the die of FIG. 1, were determined, as a parameter of "moldability" of the die, until the molded articles began showing inhomogeneity in thickness due to clogging of the die. The molded article was made to have a thickness of 2 mm, and it was measured whether the molded article has a part having a thickness up to 0.5 mm. Thicknesses of molded articles were measured every 10 cycles up to 100 molding cycles, and after 100 molding cycles thicknesses of molded articles were measured in every 50 cycles. The molding surface of the die had letter imprints, and its transcription on the molded article was estimated.

The die of FIG. 1 has a rigid body 3 having a thickness of 10 mm made of an aluminum alloy. The rigid body 3 has apertures 4 having square shapes with their edges of 20 mm for passing water. The rigid body 3 is connected to the housing 5 by bolts (not shown). The vacuum chamber was maintained at a pressure below 60 mmHg, and the compression chamber was maintained at one atmospheric pressure. After every molding operation, water is showered over the molding surface of the molding die.

The molding surface 1 and the support surface 2 of the die are composed of glass beads bonded by 4% by volume of epoxy resin. The die has a square shape having its edges of 200 mm. The die has a protrusion in its center having horizontal cross sections of squares, leaving the length of a of FIG. 1 to be 50 mm.

The glass beads of the porous molding layer 1 have a diameter distribution such that at least 80% of the beads have their diameters in the range 0.15 mm less than the average diameter thereof to 0.15 mm more than the average pore diameter thereof. The thickness of the porous molding layer 1 includes a contribution of particles of the porous molding layer 1 incorporated between particles of the porous support layer 2.

The glass beads of the porous support layer 2 have a diameter distribution such that substantially all the beads have their diameters in the range of 30% less than the average diameter thereof to 30% more than the average pore diameter thereof. The thickness of the porous support layer 2 is about 25 mm.

To prepare the die, onto a master mold made of a resin having a depression in its center, which has a surface shaped in the desired configuration, was laminated glass beads for the molding surface 1 mixed with an epoxy resin to a certain thickness. Then glass beads for the support surface 2 mixed with the epoxy resin were laminated on the molding surface 1 to a thickness of 25 mm, followed by providing the rigid body 3 on the support surface 2. The molding surface 1 is bonded to the porous support layer 2 by the epoxy resin, and the porous support layer 2 is bonded to the rigid body 3. The resulting die was removed from the master mold.

Using these dies the number of continuous molding cycles was determined until the die got clogged by the method shown in Table 1.

These results are tabulated in FIGS. 16–21.

Transcription of the letters to molded articles by the present invention is satisfactory.

The molding die having a specific property of the porous molding layer and the porous support layer is not prone to clogging, and the die gives a molded pulp article having a smooth surface without joints. Moreover, the method according to the invention prevents a die from clogging, and the permeability of the die does not deteriorate even after 600 molding cycles so that the method enables continuous molding operations.

In contrast outside the scope of the invention the die does not have a sufficient permeability and is prone to clogging, resulting in a limited number of molding cycles. Moreover, molded pulp articles do not have a surface as smooth as those produced using the mold and process of the present invention.

What is claimed is:

1. A pulp molding die for molding shaped articles from fiber pulp, said die comprising:

a porous molding layer having a porosity of at least 5% and an average pore diameter in a range of 60 to 1000 μm, said porous molding layer having a molding surface shaped to the configuration of the article to be molded;

a porous support layer disposed adjacent said porous molding layer on substantially the entire opposite side thereof from said molding surface, said porous support layer having a porosity of at least 20% and an average pore diameter in a range of 0.6 to 10 mm, said average pore diameter being larger than that of said porous molding layer;

first means for holding water in said die by capillary attraction, said first means comprising a pore structure defined by at least one of said porous molding layer and said porous support layer; and second means for allowing substantially uniform flow of air through said porous molding layer over substantially said entire opposite side thereof, said second means comprising a pore structure defined by said porous support layer.

2. A pulp molding die according to claim 1, wherein at least one of said porous molding layer and said porous support layer has an interconnected pore structure.

3. A pulp molding die according to claim 1, wherein said die has an air flow characteristic such that when air pressure of 300 mm Aq is applied at said molding surface the air flow rate, Q, through the die is $50 \leqq Q \leqq 600$, wherein Q is $ml.A^{-1}.s^{-1}$, A is the surface area of the molding surface in cm$^2$, ml is the volume of air in cm$^3$ that passes through said die, and s is seconds.

4. A pulp molding die according to claim 1, wherein said porous molding layer has a thickness in a range of 0.1 to 20 mm.

5. A pulp molding die according to claim 5, wherein a thickness of said porous molding layer is at least 0.1 mm and less than 5 mm.

6. A pulp molding die according to claim 1, wherein at least 80% of pores in said porous molding layer have pore diameters in a range of 25% less than said average pore diameter thereof to 25% more than said average pore diameter.

7. A pulp molding die according to claim 1, wherein said average pore diameter of said porous support layer is 1.5 to 10 times the average pore diameter of said porous molding layer.

8. A pulp molding die according to claim 1, wherein at least one of said porous molding layer and said porous support layer comprises a plurality of water-insoluble particles bonded together.

9. A pulp molding die according to claim 1, wherein at least one of said porous molding layer and said porous support layer comprises a porous material formed by electroforming.

10. A pulp molding die according to claim 1, wherein at least one of said porous molding layer and said porous support layer comprises a honeycomb structure.

11. A pulp molding die according to claim 1 wherein at least one of said porous molding layer and said porous support layer comprises a perforated metal plate.

12. An apparatus for molding shaped pulp articles from fiber pulp, comprising:

a pulp molding die comprising a porous molding layer having a porosity of at least 5% and an average pore diameter in a range of 60 to 1000 μm, said porous molding layer having a molding surface shaped to the configuration of the article to be molded; a porous surface layer disposed adjacent said porous molding layer on substantially the entire opposite side thereof from said molding surface, said porous support layer having a porosity of at least 20% and an average pore diameter in a range of 0.6 to 10 mm, said average pore diameter being larger than that of said porous molding lyaer first means for holding water in said die by capillary attraction, said first means comprising a pore structure defined by at least one of said porous molding layer and said porous support layer; and second means for allowing substantially uniform flow of air through said porous molding layer over substantially said entire opposite side thereof, said second means comprising a pore structure defined by said porous support layer; said die having an inside surface remote from said molding surface;

means for adding cleaning water to said die so that cleaning water is incorporated in said pore structure thereof; and means for applying air impulse pressure to said inside surface of said die to drive water from said pore structure thereof.

13. An apparatus according to claim 12, wherein said means for adding cleaning water comprises spraying means for spraying cleaning water onto said molding surface of said die.

14. An apparatus according to claim 13, wherein said means for applying air pressure comprises a container for compressed air, a conduit connecting said container to said inside surface of said die, and a valve in said conduit.

* * * * *